US010203179B2

(12) United States Patent
Hodgson

(10) Patent No.: US 10,203,179 B2
(45) Date of Patent: Feb. 12, 2019

(54) MOTORIZED WEAPON GYROSCOPIC STABILIZER

(71) Applicant: Dale Albert Hodgson, Chardon, OH (US)

(72) Inventor: Dale Albert Hodgson, Chardon, OH (US)

( * ) Notice: Subject to any disclaimer, the term of this patent is extended or adjusted under 35 U.S.C. 154(b) by 177 days.

(21) Appl. No.: 15/163,728

(22) Filed: May 25, 2016

(65) Prior Publication Data

US 2016/0377372 A1 Dec. 29, 2016

Related U.S. Application Data

(63) Continuation-in-part of application No. 14/844,103, filed on Sep. 3, 2015, now Pat. No. 9,354,013, which is a continuation-in-part of application No. 13/738,186, filed on Jan. 10, 2013, now Pat. No. 9,146,068.

(60) Provisional application No. 61/585,267, filed on Jan. 11, 2012, provisional application No. 62/107,666, filed on Jan. 26, 2015.

(51) Int. Cl.

| | |
|---|---|
| ***F41C 27/22*** | (2006.01) |
| ***F41A 21/36*** | (2006.01) |
| ***F41A 21/30*** | (2006.01) |
| ***F41A 27/30*** | (2006.01) |
| ***F41G 1/32*** | (2006.01) |
| ***F41G 3/12*** | (2006.01) |

(52) U.S. Cl.

CPC ..... *F41C 27/22* (2013.01); *F41A 21/30* (2013.01); *F41A 21/36* (2013.01); *F41A 27/30* (2013.01); *F41G 1/32* (2013.01); *F41G 3/12* (2013.01)

(58) Field of Classification Search

CPC ..... F41C 27/22; F41A 21/36; F41A 27/30; F41G 5/16

USPC ..... 42/1.06, 97; 89/202, 41.09, 14.3, 41.01, 89/41.02, 40.01; 235/407; 74/5 R

See application file for complete search history.

(56) References Cited

U.S. PATENT DOCUMENTS

| | | | |
|---|---|---|---|
| 464,806 | A | 12/1891 | Tower |
| 640,051 | A | 12/1899 | Tower |
| 1,573,028 | A | 2/1926 | Bates |
| 2,106,998 | A | 2/1938 | Fieux |
| 2,356,189 | A | 8/1944 | Tufts |
| 2,405,052 | A | 7/1946 | Poitras et al. |
| 2,472,944 | A | 6/1949 | Furer et al. |
| 2,532,333 | A | 12/1950 | Rhyne |
| 2,534,225 | A | 12/1950 | Brown |

(Continued)

OTHER PUBLICATIONS

European search report, dated May 27, 2016, in connection with European Patent Application No. 14788495.1, filed Jan. 10, 2014.

*Primary Examiner* — Reginald S Tillman, Jr.
(74) *Attorney, Agent, or Firm* — Fay Sharpe LLP

(57) ABSTRACT

A motorized weapon gyroscopic stabilizer which creates a stabilizing effect for single shot, semi-automatic, and fully automatic weapons. The rotating mass that generates the gyroscopic stabilizing effect can be the rotor of the motor. The motor is designed to allow the mass to rotate around the open core of the motorized weapon gyroscopic stabilizer. Because of its open core design the motorized weapon gyroscopic stabilizer allows the fired projectile to pass through it, or be mounted in line with the sighting mechanism allowing the target alignment-line of sight to pass through the motorized weapon gyroscopic stabilizer, or both.

21 Claims, 21 Drawing Sheets

(56) References Cited

U.S. PATENT DOCUMENTS

| | | | | | |
|---|---|---|---|---|---|
| 2,609,606 | A | | 9/1952 | Draper et al. | |
| 2,679,192 | A | | 5/1954 | Seeley et al. | |
| 2,845,737 | A | | 8/1958 | Hoyer | |
| 2,938,435 | A | | 5/1960 | Gille | |
| 3,034,116 | A | | 5/1962 | Shelley | |
| 3,078,728 | A | | 2/1963 | Schlesman | |
| 3,144,644 | A | | 8/1964 | Getting | |
| 3,165,972 | A | | 1/1965 | Cumbo | |
| 3,362,073 | A | | 1/1968 | Hausenblas et al. | |
| 3,396,630 | A | | 8/1968 | Hinterthur et al. | |
| 3,424,522 | A | | 1/1969 | Call | |
| 3,489,057 | A | | 1/1970 | Tonkin | |
| 3,502,062 | A | | 3/1970 | Shurts | |
| 3,640,178 | A | | 2/1972 | Chatham et al. | |
| 3,664,199 | A | | 5/1972 | Lande | |
| 3,702,079 | A | * | 11/1972 | Kranz | G01C 19/28 244/79 |
| 3,913,870 | A | | 10/1975 | Bolick | |
| 4,240,302 | A | * | 12/1980 | Karnick | G01C 19/30 73/504.11 |
| 4,297,905 | A | | 11/1981 | Hadekel | |
| 4,307,653 | A | | 12/1981 | Goes et al. | |
| 4,476,969 | A | | 10/1984 | Dykema | |
| 4,621,266 | A | | 11/1986 | Le Gall et al. | |
| 4,974,493 | A | | 12/1990 | Yeffman | |
| 5,113,745 | A | | 5/1992 | Allen | |
| 5,339,789 | A | | 8/1994 | Heitz | |
| 6,227,098 | B1 | | 5/2001 | Mason | |
| 6,234,045 | B1 | | 5/2001 | Kaiser | |
| 6,941,851 | B2 | | 9/2005 | Urvoy | |
| 7,870,814 | B2 | | 1/2011 | Lounsbury | |
| 8,028,611 | B2 | | 10/2011 | Loundsbury | |
| 8,220,448 | B1 | | 7/2012 | Moggo | |
| 9,146,068 | B2 | | 9/2015 | Hodgson | |
| 2006/0005447 | A1 | | 1/2006 | Lenner et al. | |
| 2010/0281726 | A1 | | 11/2010 | Lounsbury | |
| 2011/0275435 | A1 | | 11/2011 | Torre | |
| 2012/0030984 | A1 | | 2/2012 | Andersson | |

* cited by examiner

MOTORIZED WEAPON GYROSCOPIC STABILIZER

RELATED APPLICATIONS

The present application is a continuation-in-part of currently pending U.S. patent application Ser. No. 14/844,103, filed on Sep. 3, 2015, which claims priority to U.S. Provisional Patent Application Ser. No. 62/107,666, filed Jan. 26, 2015, and which is a continuation-in-part of U.S. patent application Ser. No. 13/738,186, filed on Jan. 10, 2013, which is now U.S. Pat. No. 9,146,068, issued Sep. 29, 2015, which application claims priority to U.S. Provisional Patent Application Ser. No. 61/585,267, filed on Jan. 11, 2012, the entire contents of all applications being incorporated herein by reference.

BACKGROUND

The present application relates to weapon stabilizer systems. It finds particular application in utilizing a motorized weapon gyroscopic stabilizer to create a stabilizing effect for single shot, semi-automatic, and fully automatic weapons, and will be described with particular reference thereto. It is to be understood, however, that it also finds application in other devices, and is not necessarily limited to the aforementioned application.

Shooting a weapon depends on a high degree of precision. Slight movements made by the shooter significantly alter the accuracy of the shot. This variation in target alignment is made even more significant when compounded over long distances. Over time, shooters have been taught to minimize these movements by using a variety of methods to create stability and support of the weapon during target alignment and firing of the weapon. This desired stability of the target alignment is so critical that a shooter is taught to measure his breaths, and be aware of his heartbeats as he prepares for his shot. A small fraction of a degree in target misalignment when magnified over a long distance is enough to miss the target.

While there are a variety of sights, scopes, and aiming devices available for weapons, they only serve to make the shooter more aware of the existing deviations experienced during aiming and firing at his target. Typically, the shooter has the ability to support his weapon from the middle and/or rear with handgrips, and/or stock supports. When possible, a shooter enhances his stability by supporting the weapon with external stable surfaces available to him in his environment at the time. Unfortunately, due to the different conditions and environments in which a weapon is expected to function, the ideal support for the weapon is not always available. Without the aid of external stable surfaces for the weapon, the shooter is dependent on supporting the unsupported weapon with his skeletal structure incorporated into their position, and the steadiness of their muscles.

With a weapon, during the first shot, the shooter typically experiences recoil from the shot. During this recoil phase, the weapon typically moves as the projectile is fired and propelled and leaves the weapon. Typically, this recoil affects the least supported part of the weapon the most. This recoil causes alignment with the target to be altered, and requires subsequent shots to be made after adjusting target alignment, causing a delay in repeated firing and the ability to aim accurately. The less the natural recoil of the weapon affects the target alignment, the faster the target can be reacquired, and subsequent shots may be made. This recoil problem is present with single shot, semi-automatic, and fully automatic weapons.

Gyroscopes have been utilized in the past in a wide variety of stabilizing applications, but size, weight, and bulk have limited their application related to the handheld weapon field. Gyroscopes are heavy and cumbersome, and while used for applications such as on cameras, missiles, battleship guns, and tanks, they have never been practically used on handheld weapons.

The present application provides a weapon stabilizer system and apparatus which overcomes the above-referenced problems and others.

SUMMARY

In accordance with one aspect, a motorized weapon gyroscopic stabilizer system is provided. The system includes a housing including an open core rigidly mounted to a barrel of a weapon. A motor includes a rotor configured to provide gyroscopic stability, the rotor surrounding the open core and including an axis of rotation and a mass element configured to rotate around the axis of rotation.

The motorized weapon gyroscopic stabilizer improves the stability of a weapon during single shots, semi-automatic shots, and fully automatic shots through the use of a lightweight high speed motor driven gyroscopic stabilization device. The device relies on the three primary variables involved in creating gyroscopic stability; the mass of the spinning element, the speed of the spinning element, and the diameter of the spinning element. By altering any of these three variables, the gyroscopic stability is altered. However, emphasis may be placed on any of these three variables to overcome the limitations applied to any of the other variables.

To accomplish gyroscopic stability, the motorized weapon gyroscopic stabilizer utilizes a low mass, high speed motor driven gyroscope designed to spin on an axis parallel to the weapons direction of fire and/or target alignment method/device. The motorized weapon gyroscopic stabilizer also utilizes a method to increase the speed of the spinning mass to produce extremely high revolutions per minute allowing the device to lower the mass of the spinning mass element while achieving the same gyroscopic stability, thus making the device lighter.

The device creates its gyroscopic stability through the spinning mass of its rotor, around its hollow core. The motor is designed to spin on an axis parallel to the weapons direction of fire and/or target alignment method/device.

The motorized weapon gyroscopic stabilizer is also designed to minimize bulk by integrating the gyroscope into the weapons natural structure emphasizing its attachment in line with the axis parallel to the weapons direction of fire and/or target alignment method/device. The device has a small rotational mass diameter and compensates for this through its high speed rotation. The diameter of the spinning mass element is critical to the function of a gyroscope. Increasing the diameter, increases the gyroscopic stability it generates. The motorized weapon gyroscopic stabilizer is designed with a hollow rotational axis which allows it to share space with other functional elements incorporated into all weapons, such as, but not limited to; by way of example in a firearm type weapon; its barrel, its axis parallel to the weapons direction of fire, and/or with the target alignment-line of sight method/device natural to the firearm.

This sharing of space allows the motorized weapon gyroscopic stabilizer to incorporate with the natural form of the weapon, and prevent the bulk of adding a separate large cylindrical shape, which is essential to create a gyroscopic stabilizer, somewhere else on a weapon. Due to this form, it allows the device to be positioned as far away as practical from the already existing support surfaces on the weapon to maximize the gyroscopic stability it provides.

This motorized weapon gyroscopic stabilizer is designed to be either rigidly attached or be made removable from the weapon. The attachment method varies and is dependent on the design and the configuration of the specific weapon, and may be attached either permanently, or temporarily. This is fully capable of being added to, or removed from the weapon, or in being temporarily attached or permanently affixed into the weapons structure.

The motorized weapon gyroscopic stabilizer is designed to be either used independently, or incorporated into other devices including but not limited to; barrels, flash suppressors, silencers, noise suppressors, scopes, lasers, optics, holographic sights, target alignment devices, and other devices benefiting from its unique hollow core construction.

Still further advantages of the present invention will be appreciated by those of ordinary skill in the art upon reading and understanding the following detailed description.

The invention may take form in various components and arrangements of components, and in various steps and arrangements of steps. There are many forms of motors with which this invention works. For illustration purposes only, the following preferred embodiments show this invention as a separate motor as well as an integral brushless motor. The drawings are only for purposes of illustrating the preferred embodiments and are not to be construed as limiting the invention.

DETAILED DESCRIPTION

Figure 1:
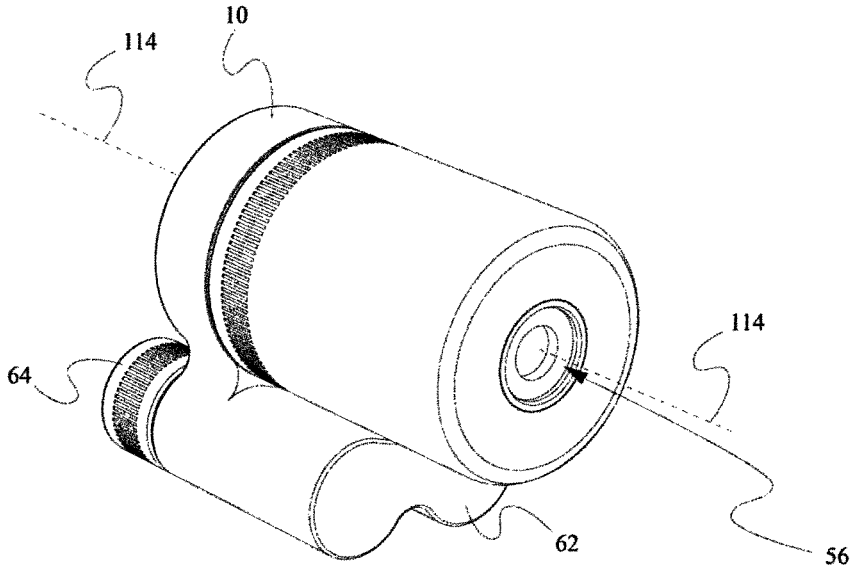
FIG. 1 is an illustration of the motorized weapon gyroscopic stabilizer as viewed from the front perspective view. In this view, the device is not mounted to a weapon.

FIG. 1 shows a front perspective view of a preferred embodiment of the motorized weapon gyroscopic stabilizer 10. This view of one embodiment shows the body of the stabilizer with an integrated battery or batteries holder 62 for powering the unit. The battery or batteries 82 are contained within the enclosure and secured in place with a battery cap or battery caps 64. This view shows the axis of rotation which is parallel to an axis of a trajectory 114 allowing a fired projectile to pass through the open core in the motorized weapon gyroscopic stabilizer 56.

Figure 2:
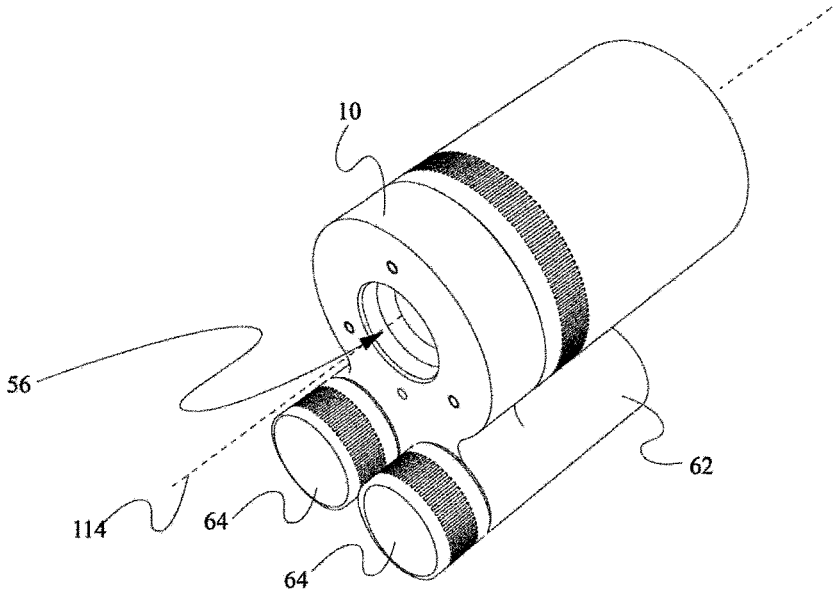
FIG. 2 is an illustration of the motorized weapon gyroscopic stabilizer as viewed from the rear perspective view. In this view, the device is not mounted to a weapon.

FIG. 2 shows a rear perspective view of a preferred embodiment of the motorized weapon gyroscopic stabilizer 10. This illustration of one embodiment shows the body of the device with an integrated battery or batteries holder 62 for powering the unit. The battery or batteries 82 are contained inside of the unit with temporarily secured battery cap or batteries caps 64. The battery cap or batteries caps 64 may be attached in a wide variety of ways; including but not limited to, by way of example; thread attached, independent hardware attached, snap fit, or friction fit. This view shows the axis of rotation which is parallel to an axis of a trajectory 114 allowing a fired projectile to pass through the open core in the motorized weapon gyroscopic stabilizer 56.

Figure 3:
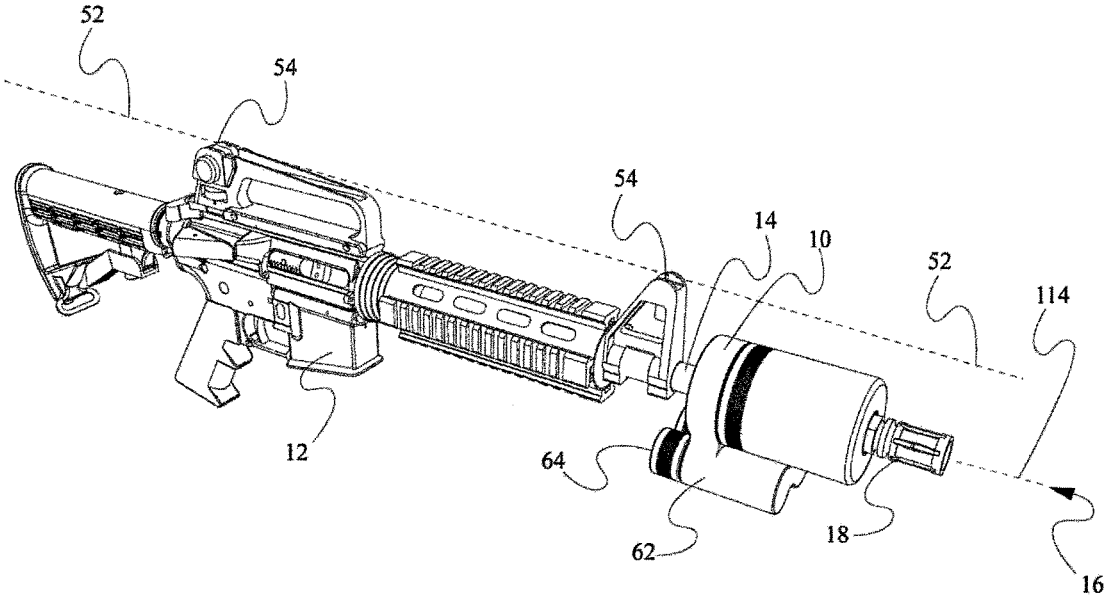
FIG. 3 is an illustration of the motorized weapon gyroscopic stabilizer mounted to a weapon, by way of example the barrel of a firearm.

With reference to FIG. 3, the motorized weapon gyroscopic stabilizer 10 is illustrated by way of example as being mounted onto the barrel 14 of a weapon 12. Such type of weapon 12 includes a single shot, semi-automatic, or fully automatic weapon 12 with either single or multiple barrels 14. By way of example, the motorized weapon gyroscopic stabilizer 10 is rigidly attached to the barrel 14 of a rifle type weapon 12. The barrel 14 passes through the motorized weapon gyroscopic stabilizer 10 and is secured by way of example by the attachment of a flash suppressor 18 or other retention method. This method of attachment is only one method of attaching the motorized weapon gyroscopic stabilizer 10 to a weapon 12. Since weapon 12 configurations vary significantly, the attachment method varies according to the weapon 12. The projectile exit 16 of the weapon 12 allows the projectile to pass through the motorized weapon gyroscopic stabilizer 10. The motorized weapon gyroscopic stabilizer 10 is intended to work with single and multiple barrel weapons 12. The motorized weapon gyroscopic stabilizer 10 provides stability to the weapon 12 by the extremely fast rotation of the cylinder of mass around the hollow core of the device. The center of rotation as shown by way of example is aligned with the barrel 14 of the weapon 12 so that the projectile passes through the motorized weapon gyroscopic stabilizer 10 along an axis of rotation which is parallel to an axis of a trajectory 114. In other configurations, the motorized weapon gyroscopic stabilizer 10 allows the target alignment-line of sight 52 to pass through the device, or function having both the target alignment-line of sight 52 and the axis of the projectile exit 16 aligned through the motorized weapon gyroscopic stabilizer 10 allowing the projectile to pass through the device as well. The sighting mechanism 54 used on the weapon may vary considerably, which include visual, non-magnified, magnified, optical or other types of sighting mechanisms 54 designed to create target alignment-line of sight 52 function through the open core of this device.

Figure 4:
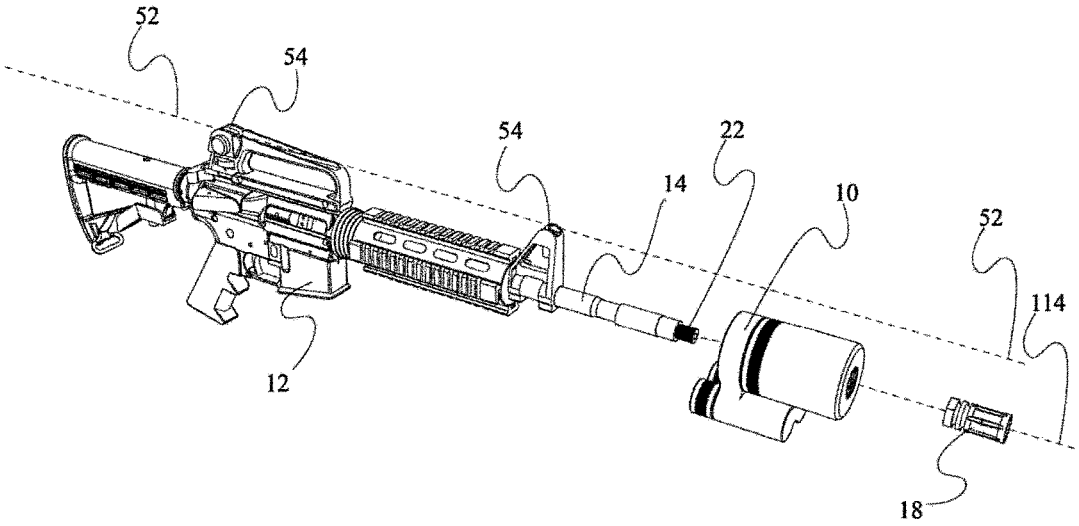
FIG. 4 is an illustration of the motorized weapon gyroscopic stabilizer mounted to a weapon through one of the many ways of attachment by way of example the barrel of a firearm.

In FIG. 4, the motorized weapon gyroscopic stabilizer 10 is shown being mounted onto a weapon 12 in another example. As illustrated, the motorized weapon gyroscopic stabilizer 10 is shown by way of example on a rifle type weapon 12 being rigidly attached by using the threaded portion of the barrel 22 of the weapon 12 along with the threaded flash suppressor 18 normal to this type of weapon 12. In other rifle or pistol type weapons 12, the motorized weapon gyroscopic stabilizer 10 is attached onto the barrel 14, or in front of the barrel 14 with different brackets or attachment modifications making it; permanently incorporated into the barrel 14, rigidly fixed to the barrel 14, or temporarily fixed to the barrel 14 depending on the application. The motorized weapon gyroscopic stabilizer 10 is able to be mounted in similar ways to the weapon 12 with the target alignment-line of sight 52 passing through it. The mass of rotation has an axis of rotation which is parallel to an axis of a trajectory 114 of a fired projectile and/or target alignment line of sight 52.

Figure 5:
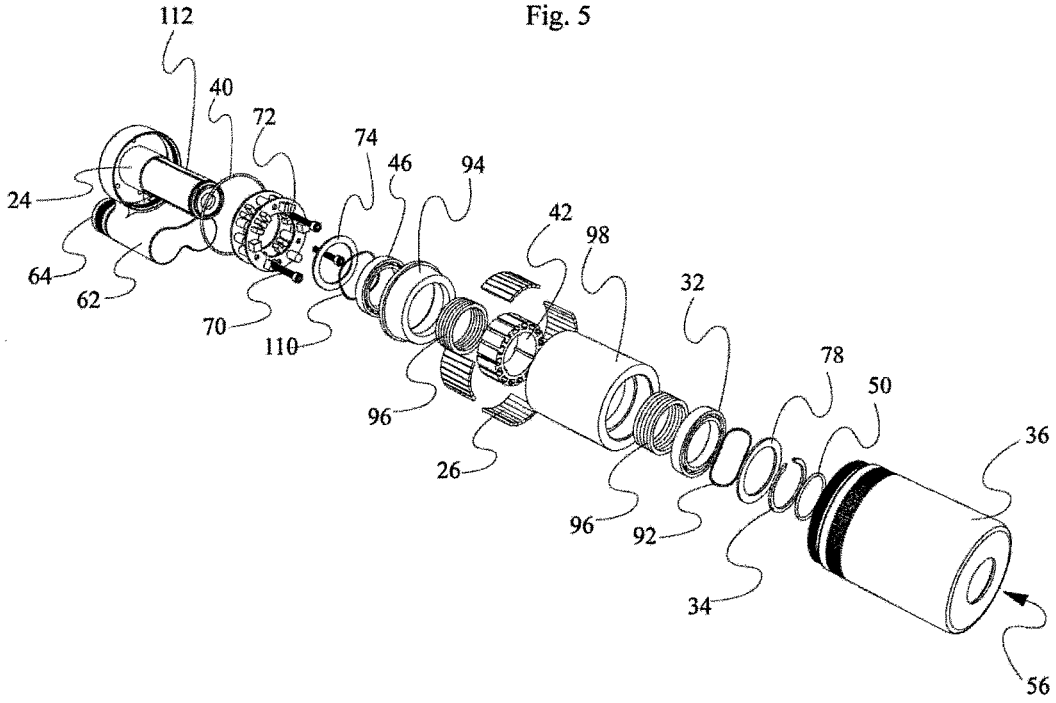
FIG. 5 is an illustration of an exploded view of the motorized weapon gyroscopic stabilizer as constructed by way of example as an integral motor version.

FIG. 5 illustrates an exploded view of the motorized weapon gyroscopic stabilizer 10 as constructed by way of example as an integral motor version of the motorized weapon gyroscopic stabilizer 10. The spinning mass can be made as a one piece or as a multiple piece assembly. By way of example, in this preferred embodiment of the device, the spinning mass is made of two halves joined together; the front rotor half 98 and the rear rotor half 94. When assembled together, the two comprise a complete spinning mass. In this embodiment of the device, the inner housing 24 is created with an integrated battery or batteries holder 62 to allow the placement of a battery or batteries 82 inside the main inner housing 24. The battery or batteries 82 are sealed by using a battery cap or battery caps 64. The battery cap or battery caps 64 can be threaded, snapped, friction fit, mechanically attached, clipped or any other attachment method, in place, but are shown in this preferred embodiment as thread attached to the battery or batteries holder 62 portions of the inner housing 24. The inner housing 24 is designed to create the open core shaft of the motorized weapon gyroscopic stabilizer 10, allowing it to be mounted to a weapon 12 in a variety of ways. The inner housing 24 is rigidly attached to the outer housing 36, making water resistant assembly possible. By way of example, the inner housing 24 is shown as threaded, although there are many different methods to rigidly attach the inner housing 24 to the outer housing 36. The inner housing 24 may be constructed of a wide variety of different materials. The rear ring seal 40 attaches to the inner housing 24 to create the rear portion of the water resistant seal to the elements. An electronic power board 72 houses electronics which powers and controls the motorized weapon gyroscopic stabilizer 10. The electronic power board 72 controls the operation of the motor, and is programmed to provide speeds and start-stop settings for the motor function. The electronic power board 72 can be rigidly attached to the inside of the inner housing 24 or may be located on different locations on the weapon 12 depending on the configuration of the weapon 12. The retaining screws 70 secure the electronic power board 72 to the inner housing 24 and hold the elements in position inside the motorized weapon gyroscopic stabilizer 10. The rear ring 74 is positioned around the shaft portion of the inner housing 112 and the rear side of the rear wavy spring 110. The rear wavy spring 110 provides constant pressure against the rear bearing 46. The rear bearing 46 is pressed into the rear rotor half 94. The rear bearing 46 may be several types of construction, including but not limited to a ball, wheel, roller, radial ball, angular contact, tapered roller, spherical roller, cylindrical roller, pillow block, thrust roller, needle roller, magnetic, or non-contact bearing. The rear bearing 46 materials may be varied and include, but not limited to; metal, plastic, non-ferrous or ceramic construction. The rear bearing 46 is positioned around the shaft portion of the inner housing 112. The spacer rings 96 are positioned around the shaft portion of the inner housing 112 and are located between the rear bearing 46 and the stator and windings 42. The wire windings of the stator and windings 42 are not shown in the illustration for clarity. The stator and windings 42 are engaged into channels around the shaft portion of the inner housing 112 to prevent rotation of the stator and windings 42. The stator and windings 42 are formed from stacks of electric steel with wire windings wound around their poles. The pattern of the stator and windings 42 are varied according to the desired speed and torque of the motor. The magnets 26 are bonded on the inside of the front rotor half 98 to create the magnetic portion of the motor. The magnets 26 count and spacing may be varied according to the desired speed and torque of the motor, and to adjust the magnetic poles of the motor. The magnets 26 are shown as independent elements but may be constructed as an integrated formed magnetic pole section in many different configurations. Another set of spacer rings 96 are positioned around the shaft portion of the inner housing 112 and are located between the front of the stator and windings 42 and the front bearing 32. The front bearing 32 is pressed inside of the front rotor half 98. The front bearing 32 may be several types of construction, including but not limited to a ball, wheel, roller, radial ball, angular contact, tapered roller, spherical roller, cylindrical roller, pillow block, thrust roller, needle roller, magnetic, or non-contact bearing. The front bearing 32 materials may be varied and include, but not limited to; metal, plastic, non-ferrous or ceramic construction. The front wavy washer 92 provides constant pressure against the front bearing 32. The front wavy washer 92 is positioned around the shaft portion of the inner housing 112 and is located between the front bearing 32 and the front ring 78. The front retainer 34 is positioned around the shaft portion of the inner housing 112 and is located in front of the front ring 78. The front retainer 34 positively engages into a groove in the inner housing 24 for fixed positioning. The rear ring seal 40 and the front ring seal 50 are designed to compress between the shaft portion of the inner housing 112 and the outer housing 36 to form a water resistant seal, protecting the inner workings of the motorized weapon gyroscopic stabilizer 10 from the elements. The outer housing 36 is rigidly attached to the inner housing 24. The attachment of the inner housing 24 to the outer housing 36 may be made in many different ways, but is illustrated by way of example as a threaded attachment. The outer housing 36 provides protection to the internal elements of the motorized weapon gyroscopic stabilizer 10. The outer housing 36 may be constructed of a wide variety of different materials. Traditional motors are designed to make the motor shaft rotate. Unlike traditional motors, this integrated motor is designed to having the inner stator and windings 42 fixed in place. The main spinning mass is comprised of the rear rotor half 94 and the front rotor half 98 with its attached magnets 24. This formed spinning mass is designed to spin around the fixed shaft portion of the inner housing 112 which functions as a non-rotating shaft. In this motorized weapon gyroscopic stabilizer 10, the shaft portion of the inner housing 112 functions as the motor shaft, and the rotor is made to rotate, creating the gyroscopic force. The rotor comprised of the rear rotor half 94 and the front rotor half 98 has both front bearing 32 and rear bearing 46 pressed inside of it, and magnets 26 are internally bonded to the inner surface of the front rotor half 98. The resulting spinning mass is designed to spin at a significant speed. This view also shows the open core in the motorized weapon gyroscopic stabilizer 56.

Figure 6:
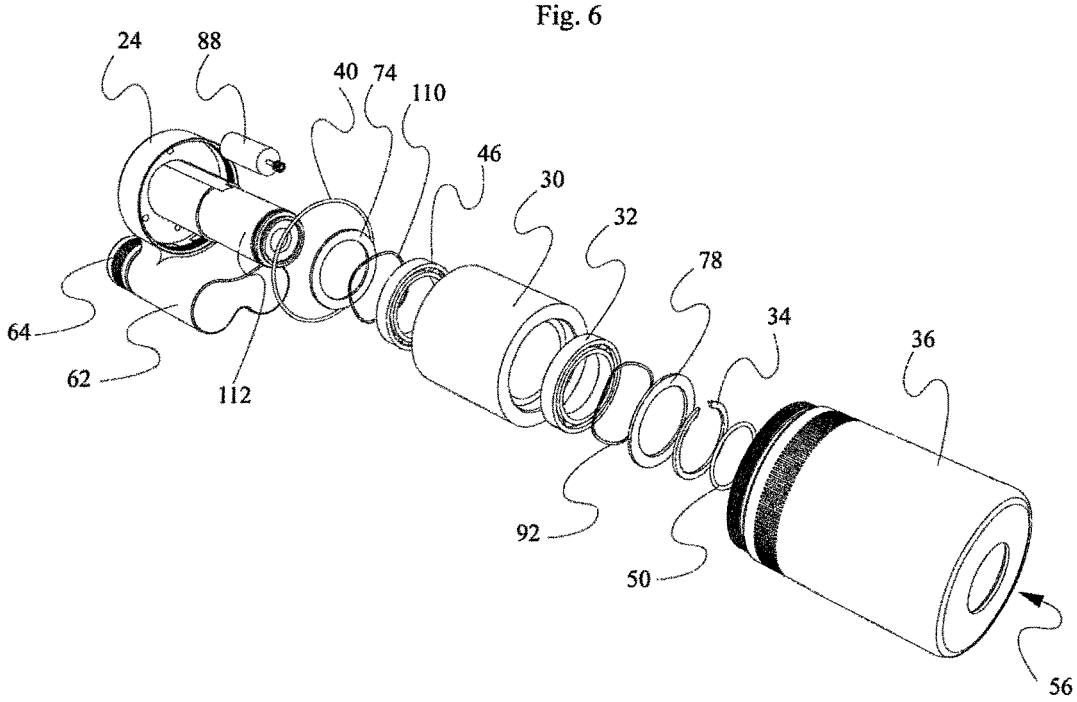
FIG. 6 is an illustration of an exploded view of the motorized weapon gyroscopic stabilizer as constructed by way of example as a separate motor driven version.

FIG. 6 illustrates an exploded view of the motorized weapon gyroscopic stabilizer 10 as constructed by way of example as a separate motor 88 driven version of the motorized weapon gyroscopic stabilizer 10. In this embodiment of the device, the inner housing 24 is created with an integrated battery or batteries holder 62 to allow the placement of a battery or batteries 82 inside the main inner housing 24. The battery or batteries 82 are sealed by using a battery cap or battery caps 64. The battery cap or battery caps 64 can be threaded, snapped, friction fit, mechanically attached, clipped or any other attachment method, in place, but are shown in this preferred embodiment as thread attached to the battery or batteries holder 62 portions of the inner housing 24. The inner housing 24 has an integrated front portion designed to create the shaft portion of the inner housing 112 of the motorized weapon gyroscopic stabilizer 10, allowing it to be mounted to a weapon 12 in a variety of ways. The inner housing 24 is rigidly attached to the outer housing 36, making water resistant assembly possible. By way of example, the inner housing 24 is shown as threaded, although there are many different methods to rigidly attach the inner housing 24 to the outer housing 36. The inner housing 24 may be constructed of a wide variety of different materials. The rear ring seal 40 attaches to the inner housing 24 to create the rear portion of the water resistant seal to the elements. A separate motor 88 mounts to the inner housing 24. The separate motor 88 is designed to drive the rotor 30 and generate gyroscopic stabilization. By way of example the separate motor 88 is mounted to the inner housing 24 using, by way of example, but not limited to; screws, hardware, clips, friction fits, press fits, snaps, adhesives, or other attachment methods. The separate motor 88 may be constructed in a wide variety of ways and may have internal regulating or external regulating circuitry that provides the necessary motor control desired. The regulating circuitry can be rigidly attached to the inside of the inner housing 24 or may be located on different locations on the weapon 12 depending on the configuration of the weapon 12. The rear ring 74 is positioned around the shaft portion of the inner housing 112 and the rear side of the rear wavy spring 110. The rear wavy spring 110 provides constant pressure against the rear bearing 46. The rear bearing 46 is pressed into the rear of the rotor 30. The rear bearing 46 may be several types of construction, including but not limited to a ball, wheel, roller, radial ball, angular contact, tapered roller, spherical roller, cylindrical roller, pillow block, thrust roller, needle roller, magnetic, or non-contact bearing. The rear bearing 46 materials may be varied and include, but not limited to; metal, plastic, non-ferrous or ceramic construction. The rear bearing 46 is positioned around the shaft portion of the inner housing 112. The front bearing 32 is pressed into the front of the rotor 30. The front bearing 32 may be several types of construction, including but not limited to a ball, wheel, roller, radial ball, angular contact, tapered roller, spherical roller, cylindrical roller, pillow block, thrust roller, needle roller, magnetic, or non-contact bearing. The front bearing 32 materials may be varied and include, but not limited to; metal, plastic, non-ferrous or ceramic construction. The front bearing 32 is positioned around the shaft portion of the inner housing 112. The front wavy spring 92 is positioned around the shaft portion of the inner housing 112 and located between the front bearing 32 and the front ring 78. The front wavy spring 92 provides constant pressure against the front bearing 32. The front ring 78 is positioned around the shaft portion of the inner housing 112 and located between the front wavy spring 92 and the front retainer 34. The front retainer 34 is positioned around the shaft portion of the inner housing 112 and located in front of the front ring 78. The front retainer 34 positively engages into a groove in the inner housing 24 for fixed positioning. The rear ring seal 40 and the front ring seal 50 are designed to compress between the shaft portion of the inner housing 112 and the outer housing 36 to form a water resistant seal, protecting the inner workings of the motorized weapon gyroscopic stabilizer 10 from the elements. The outer housing 36 is rigidly attached to the inner housing 24. The attachment of the inner housing 24 to the outer housing 36 may be made in many different ways, but is illustrated by way of example as a threaded attachment. The outer housing 36 provides protection to the internal elements of the motorized weapon gyroscopic stabilizer 10. The outer housing 36 may be constructed of a wide variety of different materials. The separate motor 88 is designed to make the rotor 30 rotate. This rotor 30 is designed to spin around the fixed shaft portion of the inner housing 112 which functions as a non-rotating shaft. In this motorized weapon gyroscopic stabilizer 10, the shaft portion of the inner housing 112 functions as the central shaft of the rotor 30. The rotor 30 is designed to rotate at a high speed, creating gyroscopic force. In its preferred embodiment, the connection between the separate motor 88 and the rotor 30 is shown by way of example, but not limited to; as a gear driven connection, although the connection could also be made through friction, belts, gears, or magnetically linked separate motor 88 and rotor 30. By way of example, the location of the separate motor 88 is shown to contact the rotor 30 from within, although the separate motor 88 alignment to the rotor could be made from the inside, the outside, on the edge, or in parallel, or in any orientation to the rotor 30 which has an axis of rotation which is parallel to an axis of a trajectory 114 of a fired projectile and/or target alignment line of sight 52. This view also shows the open core in the motorized weapon gyroscopic stabilizer 56.

Figure 7:
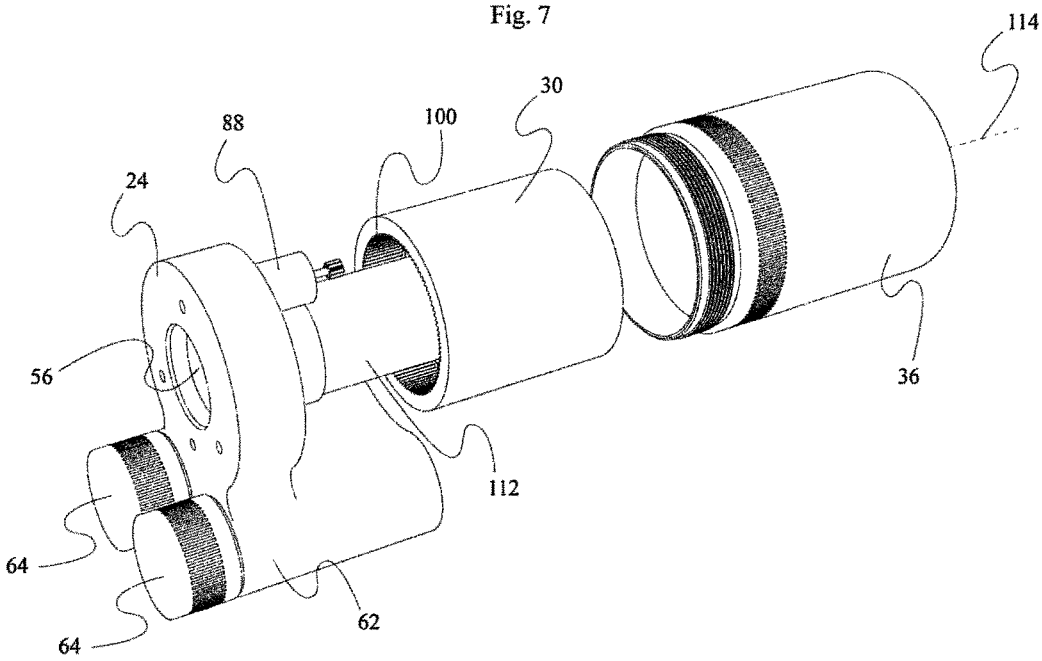
FIG. 7 is an illustration of a rear perspective exploded view of the motorized weapon gyroscopic stabilizer as constructed by way of example as a separate motor driven version.

FIG. 7 illustrates a rear perspective exploded view of the motorized weapon gyroscopic stabilizer 10 as constructed by way of example as a separate motor 88 driven version of the motorized weapon gyroscopic stabilizer 10. In this view, the separate motor 88 embodiment is shown in a clearer view showing the gears cut in the inside of the rotor 100 inside the rotor 30. In this view, the rear ring seal 40, rear ring 74, rear wavy washer 110, rear bearing 46, front bearing 32, front wavy washer 92, front ring 78, front retainer 34, and front ring seal 50, are obscured from view. The shaft portion of the inner housing 112 functions as the central shaft of the rotor 30. The rotor 30 is designed to rotate at a high speed, creating gyroscopic force. In its preferred embodiment, the connection between the separate motor 88 and the rotor 30 is shown by way of example, but not limited to; as a gear driven connection, although the drive connection could also be made as, but not limited to; friction, belts, gears, or magnetically linked drives. By way of example, the location of the separate motor 88 is shown to contact the rotor 30 from within, although the separate motor 88 alignment to the rotor could be made from the inside, the outside, on the edge, or in parallel, or in any orientation to the rotor 30 which has an axis of rotation which is parallel to an axis of a trajectory 114 of a fired projectile and/or target alignment line of sight 52 through the open core in the motorized weapon gyroscopic stabilizer 56. The inner mechanisms of the motorized weapon gyroscopic stabilizer 10 are protected by the outer housing 36.

Figure 8:
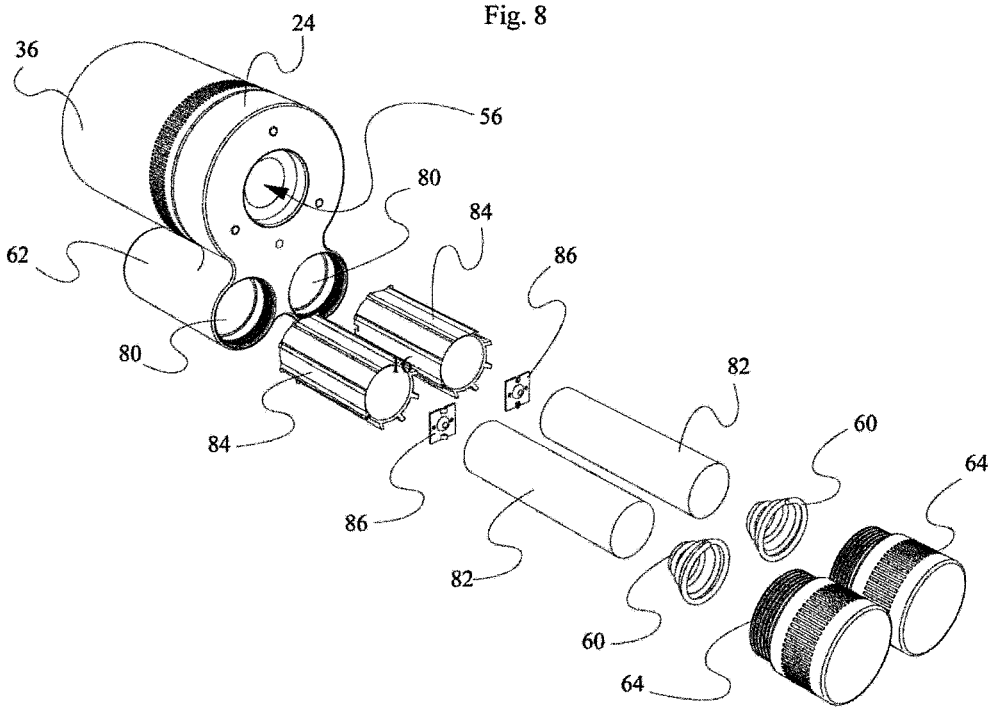
FIG. 8 is a view of the motorized weapon gyroscopic stabilizer in a rear exploded view showing by way of example an integral battery containment system.

FIG. 8 illustrates the motorized weapon gyroscopic stabilizer 10 with its integrated battery or batteries holder 62. There are many ways of incorporating a battery or batteries 82 into the device, including but not limited to this embodiment. In its preferred embodiment, by way of example, the device is shown with multiple insulated battery holder inserts 84 which hold the electrical terminals 86. The insulated battery holder inserts 84 are inserted into the opening for battery or batteries 80. The battery or batteries 82 are inserted into the insulated battery holder inserts 84 and make connection with the electrical terminals 86 and the battery holder springs 60. The battery or batteries 82 are sealed by using a battery cap or battery caps 64. The battery cap or battery caps 64 can be threaded, snapped, friction fit, mechanically attached, clipped or any other attachment method, in place, but are shown in this preferred embodiment as thread attached to the battery or batteries holder 62 portions of the inner housing 24. This view also shows the open core in the motorized weapon gyroscopic stabilizer 56.

Figure 9:
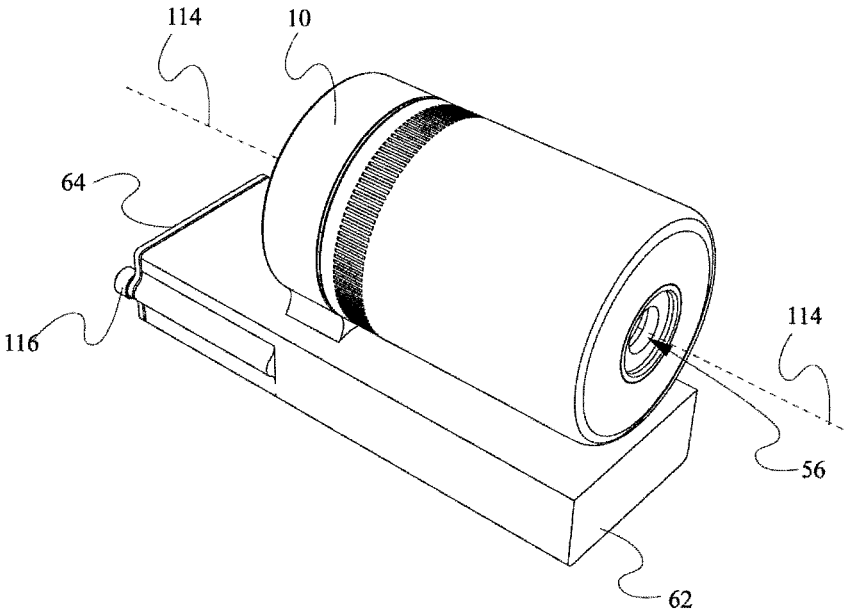
FIG. 9 is an illustration of the motorized weapon gyroscopic stabilizer attached in an alternate by way of example as an extension of the barrel of a firearm.

FIG. 9 illustrates the front perspective view of an alternative battery or batteries holder 62 of the motorized weapon gyroscopic stabilizer 10 by way of example through using a different shaped battery or batteries 82. This battery or batteries 82 may be constructed of a wide variety of chemical formulations such as by way of example but not limited to; lithium polymer, lithium Ion, nickel-metal hydride, lead-acid, nickel-zinc, nickel-cadmium, alkaline and shapes and sizes. The battery or batteries 82 may also be constructed in a wide variety of shapes and sizes by way of example as a; cylinder, rectangle, square, or custom shaped battery. The battery or batteries 82 may be made to be rechargeable or replaceable, and may be made securely fixed in position, or may be made removable by using a type of battery cap or battery caps 64. There are many methods of securing the battery or batteries 82 and or the battery or battery caps 64 onto the motorized weapon gyroscopic stabilizer 10 shown by way of example by using screw type fasteners. These many methods of attachment include but are not limited to using; clips, screws, straps, snaps, friction fits, bails, rigid hinged or flexible hinged doors, slides, or special types of fasteners. This view also shows the open core in the motorized weapon gyroscopic stabilizer 56 and the motorized weapon gyroscopic stabilizer 10 axis of rotation which is parallel to an axis of trajectory 114.

Figure 10:
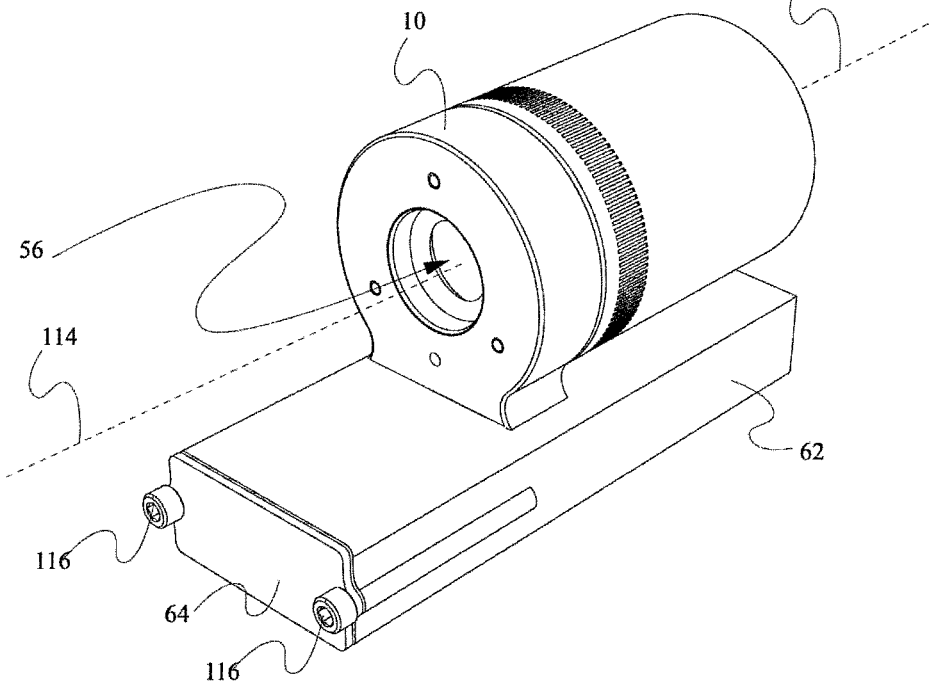
FIG. 10 is an illustration of the motorized weapon gyroscopic stabilizer attached to the barrel of a pistol type firearm.

FIG. 10 illustrates the rear perspective view of the alternative battery or batteries holder 62 of the motorized weapon gyroscopic stabilizer 10. In this view, the rear of the motorized weapon gyroscopic stabilizer 10 is clearly shown with its battery cap or battery caps 64 secured with its cover screws 116. This view also shows the open core in the motorized weapon gyroscopic stabilizer 56 and the motorized weapon gyroscopic stabilizer 10 axis of rotation which is parallel to an axis of trajectory 114.

Figure 11:
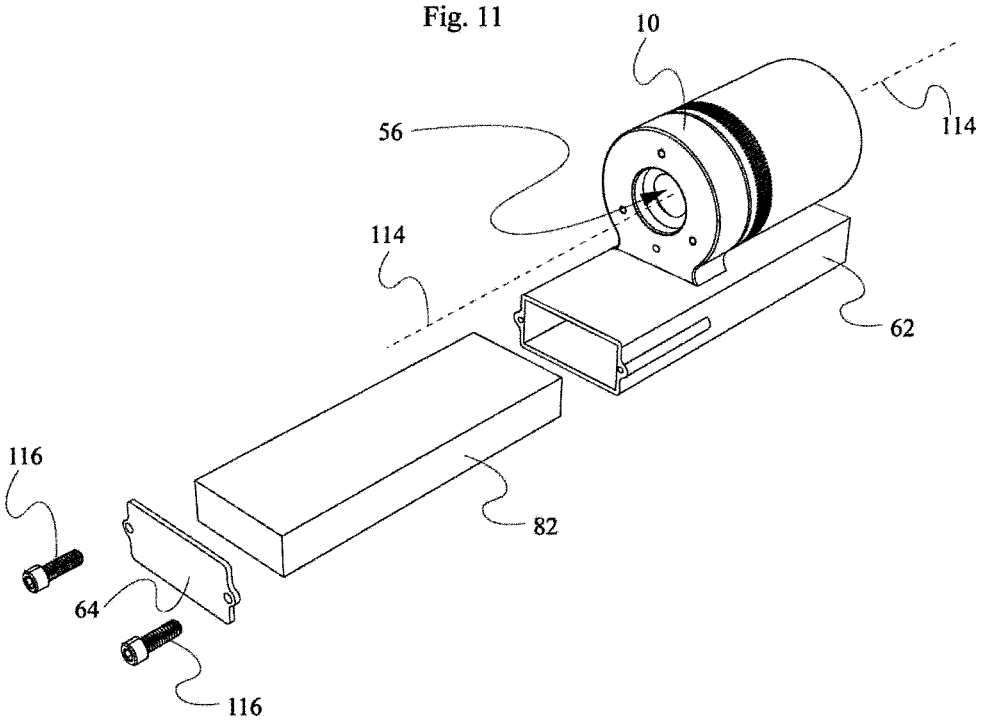
FIG. 11 is an illustration of the motorized weapon gyroscopic stabilizer attached by way of example to the barrel of a rifle type weapon with the projectile passing though the motorized weapon gyroscopic stabilizer, and the target alignment-line of sight not passing through the motorized weapon gyroscopic stabilizer.

FIG. 11 illustrates the rear perspective exploded view of the alternative battery or batteries holder 62 of the motorized weapon gyroscopic stabilizer 10 showing its battery or batteries 82 exposed, and the battery cap or battery caps 64 along with one of many securement methods as by way of example cover screws 116. This view shows the open core in the motorized weapon gyroscopic stabilizer 56 and the motorized weapon gyroscopic stabilizer 10 axis of rotation which is parallel to an axis of trajectory 114.

Figure 12:
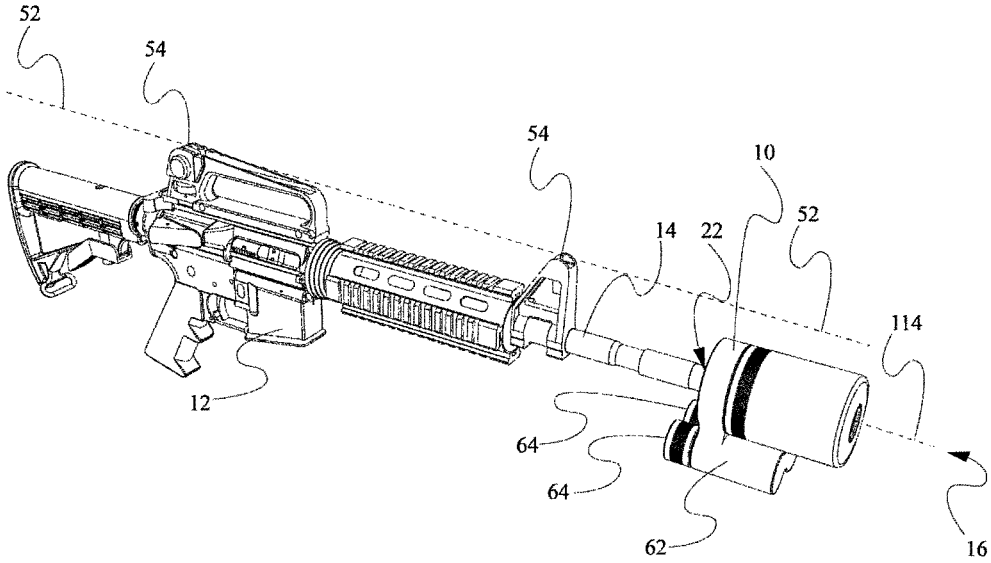
FIG. 12 is an illustration of the motorized weapon gyroscopic stabilizer attached by way of example to a rifle type firearm allowing the target alignment-line of sight to pass through the open core of the motorized weapon gyroscopic stabilizer.

FIG. 12 illustrates an alternative mounting position of the motorized weapon gyroscopic stabilizer 10 by way of example in front of the barrel 14 of a rifle type weapon 12. In this illustration, the motorized weapon gyroscopic stabilizer 10 is shown mounted in front of the barrel 14, extending the overall length of the weapon 12. Due to the open core design of this device, the motorized weapon gyroscopic stabilizer 10 is configured to perform additional functions by incorporating other barrel 14 related accessories into the design of the device, such as, but not limited to; flash suppressors, muzzle breaks, and or sound suppressors, gas tubes, or anything used in conjunction with the barrel 14 or target alignment-line of sight 52 or axis of rotation which is parallel to an axis of a trajectory 114 of a fired projectile function of the weapon 12 which would benefit by the open core construction of this device. This view also shows the projectile exit 16 in this embodiment of the device.

Figure 13:
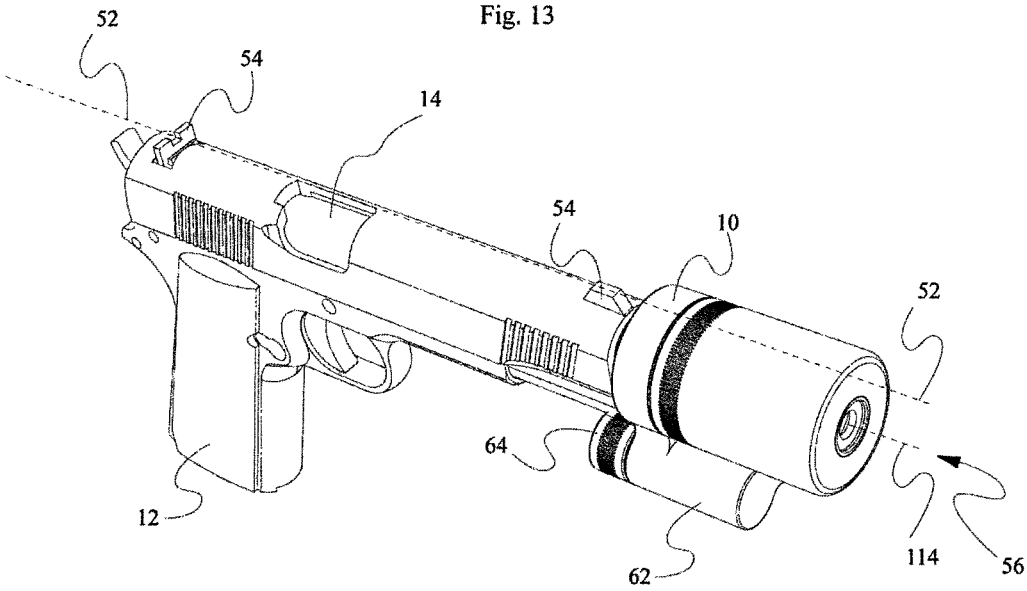
FIG. 13 illustrates the motorized weapon gyroscopic stabilizer by way of example rigidly attached to a pistol type weapon, showing the flexibility of the devices design.

FIG. 13 illustrates the motorized weapon gyroscopic stabilizer 10 by way of example rigidly attached to a pistol type weapon 12, showing the flexibility of the devices design. Because pistol type weapons 12 vary in configuration significantly, the method of attachment to the pistol type weapon 12 will vary as well. This illustration also shows how the target alignment-line of sight 52 is above the motorized weapon gyroscopic stabilizer 10, while the open core in the motorized weapon gyroscopic stabilizer 56 is aligned through the motorized weapon gyroscopic stabilizer 10 allowing the projectile to pass through it. It is also contemplated that the motorized weapon gyroscopic stabilizer 10 can be mounted to a wide variety of weapons and configured to allow either the target-alignment line of sight 52, or the axis of rotation which is parallel to an axis of a trajectory 114 of a fired projectile to pass through the open core in the motorized weapon gyroscopic stabilizer 56, or both simultaneously.

Figure 14:
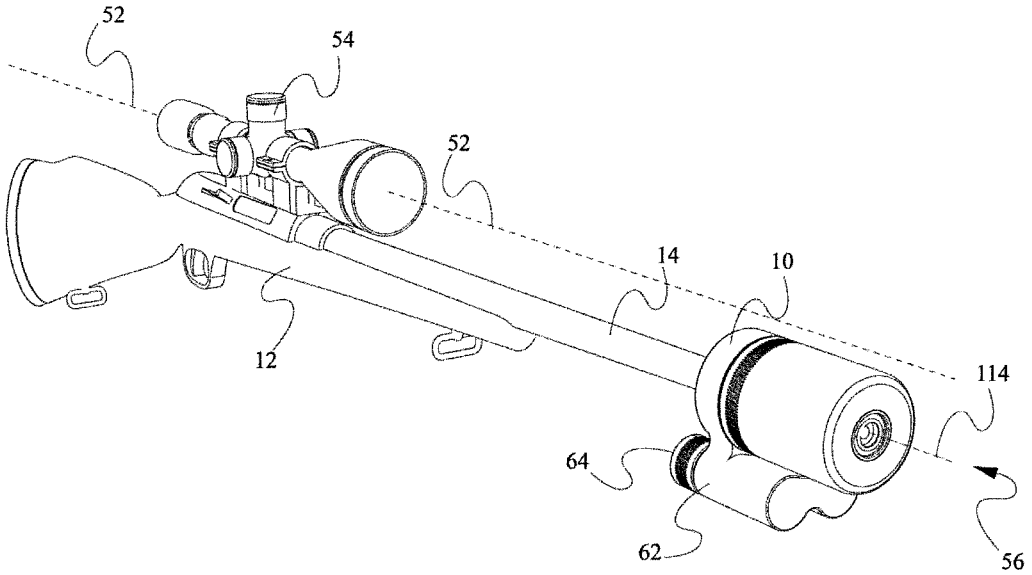
FIG. 14 illustrates the motorized weapon gyroscopic stabilizer by way of example rigidly attached to the barrel of a rifle type weapon with the target alignment-line of sight passing through the sighting mechanism.
Figure 15:
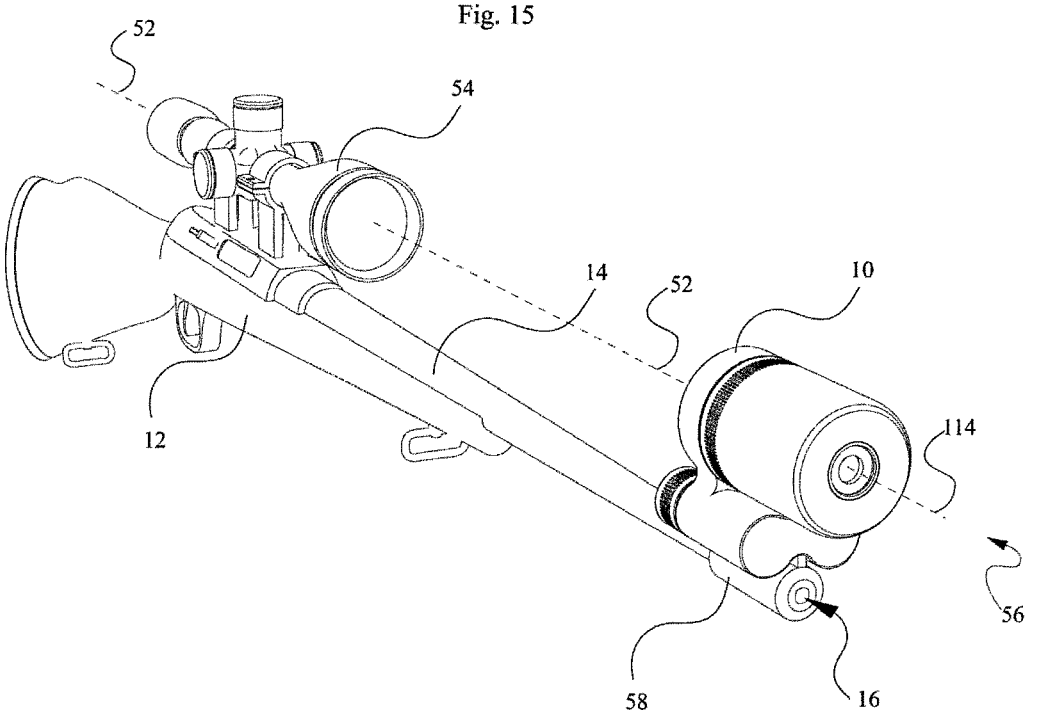
FIG. 15 illustrates the motorized weapon gyroscopic stabilizer as mounted by way of example to a rifle type weapon with the target alignment-line of sight of the sighting mechanism passing through the open core in the motorized weapon gyroscopic stabilizer.

FIG. 14 illustrates the motorized weapon gyroscopic stabilizer 10 by way of example rigidly attached to the barrel 14 of a rifle type weapon 12. Because rifle type weapons 12 vary in configuration significantly, the method of attachment to the rifle type weapon 12 will vary as well. In this example, the target alignment-line of sight 52 passes through the sighting mechanism 54 which by way of example and includes, but is not limited to a telescopic type alignment device. By way of example, the target alignment-line of sight 52 in this drawing does not pass through the motorized weapon gyroscopic stabilizer 10, although the motorized weapon gyroscopic stabilizer 10 is attached by way of example to the rifle type weapon 12 barrel 14, allowing the projectile to pass through the open core in the motorized weapon gyroscopic stabilizer 56 which has an axis of rotation which is parallel to an axis of a trajectory 114 of a fired projectile FIG. 15 illustrates the motorized weapon gyroscopic stabilizer 10 as mounted by way of example to a rifle type weapon 12. It is mounted to the barrel 14 of the weapon 12 by a support for the motorized weapon gyroscopic stabilizer 58, allowing the target alignment-line of sight 52 of the sighting mechanism 54 to pass through the open core in the motorized weapon gyroscopic stabilizer 56. In this configuration, the projectile does not pass through the open core of the motorized weapon gyroscopic stabilizer 10, but the target alignment-line of sight 52 passes through the axis of rotation which is parallel to an axis of trajectory and the open core in the motorized weapon gyroscopic stabilizer 114.

Figure 16:
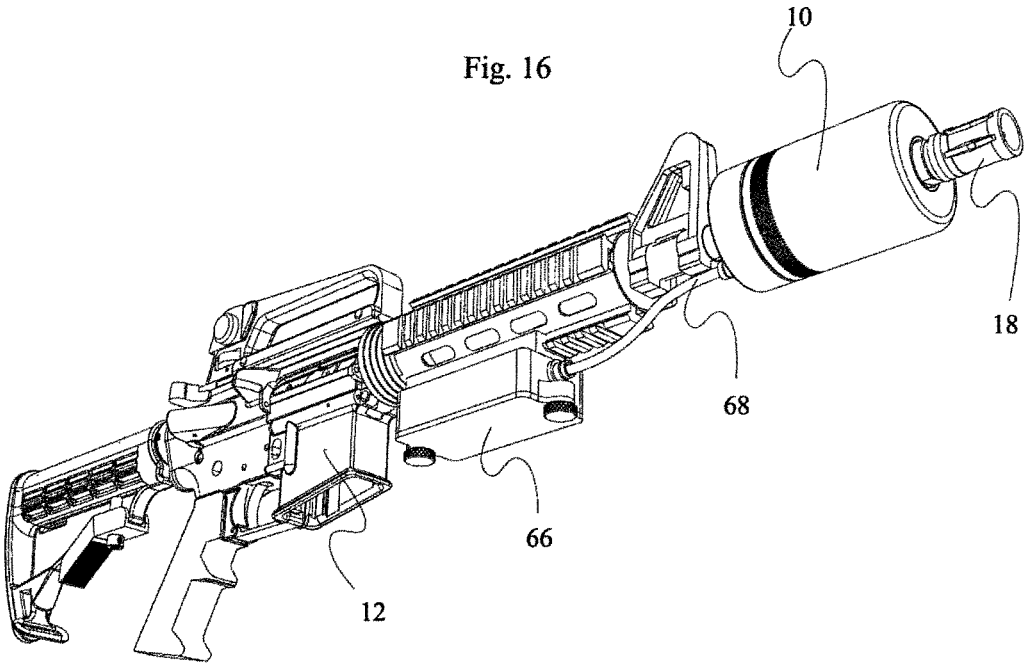
FIG. 16 illustrates a different embodiment of the motorized weapon gyroscopic stabilizer as mounted by way of example to a rifle type weapon with the battery case mounted to the gun rail and connected by a power cable.

FIG. 16 illustrates a different embodiment of the motorized weapon gyroscopic stabilizer 10 as mounted by way of example to a rifle type weapon 12. In this illustration, the motorized weapon gyroscopic stabilizer 10 is positioned on the barrel with the flash suppressor 18 located in front of it. The gyroscopic weapon stabilizer 10 is connected by way of example to the battery case 66 mounted to the weapon 12 by a power cable 68. This battery case 66 mounted to weapon 12 connected to the power cable 68 provides the energy needed to power the motorized weapon gyroscopic stabilizer 10. The battery case 66 may take many forms by way of example but not limited to; as a rectangle, cylinder, square, freeform or other entity such as a handgrip or stock.

Figure 17:
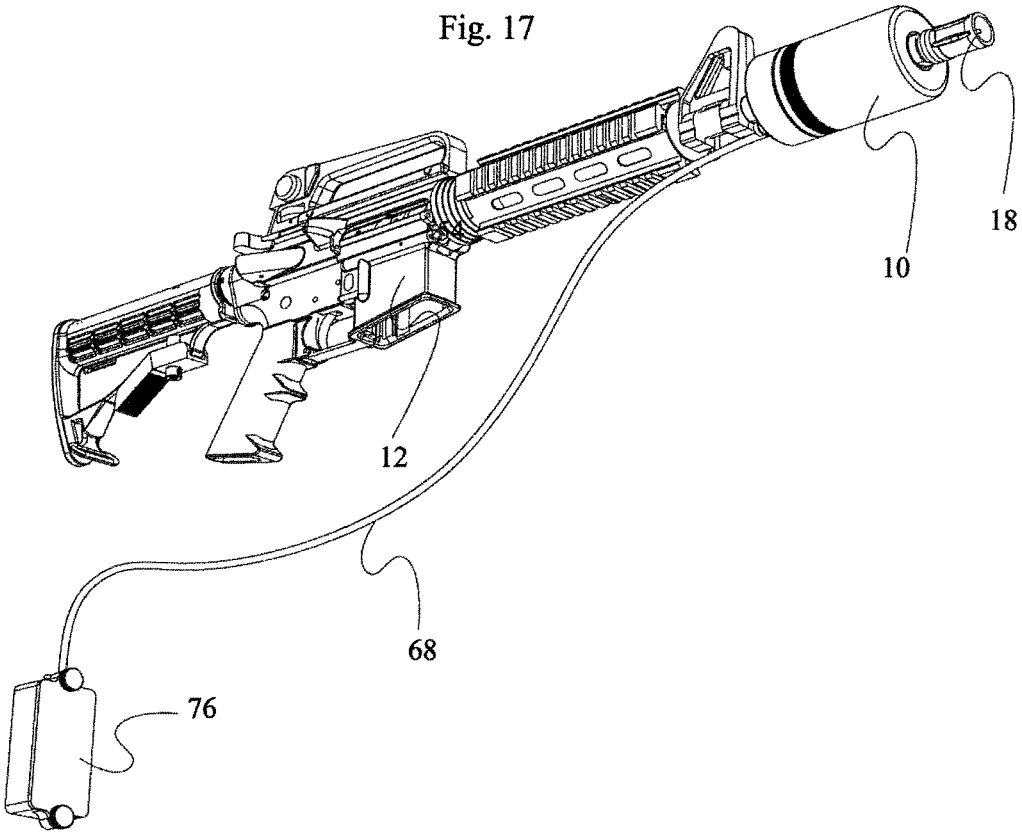
FIG. 17 illustrates an embodiment of the motorized weapon gyroscopic stabilizer as mounted by way of example to a rifle type weapon with the gyroscopic weapon stabilizer is connected by way of example to the remote battery case by a power cable.

FIG. 17 illustrates another embodiment of the motorized weapon gyroscopic stabilizer 10 as mounted by way of example to a rifle type weapon 12. In this illustration, the motorized weapon gyroscopic stabilizer 10 is positioned on the barrel 14 with the flash suppressor 18 located in front of it. The gyroscopic weapon stabilizer 10 is connected by way of example to the remote battery case 76 by a power cable 68. This remote battery case 76 may be attached to the user in a wide variety of ways such as by way of example through the use of a; belt attachment, pockets, harness, direct attachment to clothing, backpack, etc. and then connected to the power cable 68 providing the energy needed to power the motorized weapon gyroscopic stabilizer 10. The remote battery case 67 may take many forms by way of example but not limited to; as a rectangle, cylinder, square, freeform or other entity such as a handgrip or stock.

Figure 18:
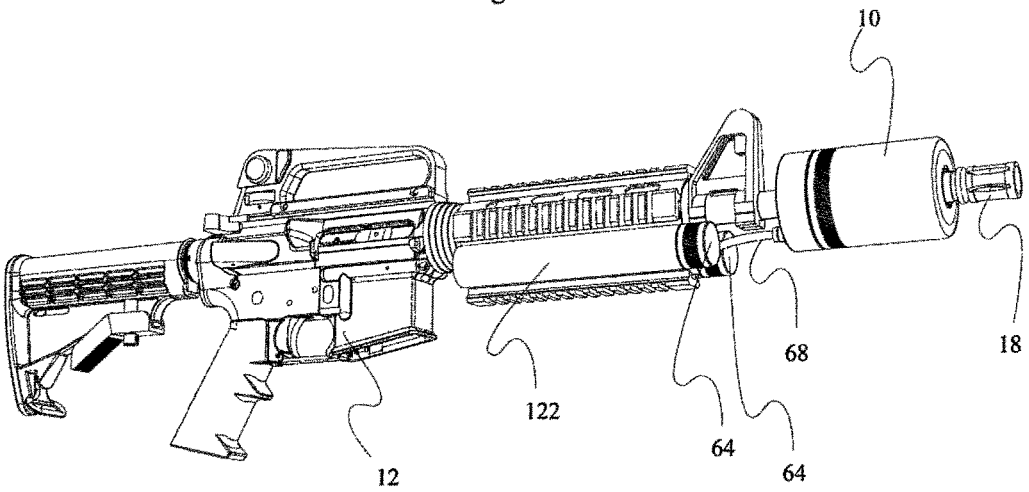
FIG. 18 illustrates another embodiment of the motorized weapon gyroscopic stabilizer as mounted by way of example to a rifle type weapon, attached to a power cable attached to a battery case incorporated into the weapon housing-stock-hand grip.

FIG. 18 illustrates another embodiment of the motorized weapon gyroscopic stabilizer 10 as mounted by way of example to a rifle type weapon 12. In this illustration, the motorized weapon gyroscopic stabilizer 10 is positioned on the barrel 14 with the flash suppressor 18 located in front of it. There are many areas within the structure of the weapon that have adequate space to house the battery or batteries 82. In this illustration, the gyroscopic weapon stabilizer 10 is connected by way of example to the battery case 66 incorporated into the weapon housing-stock-hand grip 122 by a power cable 68. The battery case 66 incorporated into the weapon housing-stock-hand grip 122 can be made in several different ways and with different materials, and designed to hold the battery or batteries 82 in many different ways with different closure methods depending on the construction of the weapon 12. In this preferred embodiment, the weapon housing-stock-handgrip 122 holds the battery or batteries 82 secured by the battery cap or battery caps 64. The weapon housing-stock-hand grip 122 may be connected directly to the motorized weapon gyroscopic stabilizer 10, or as shown in the illustrated embodiment, may be connected to it by the use of a power cable 68 providing the energy needed to power the motorized weapon gyroscopic stabilizer 10. The battery case 66 may take many forms by way of example but not limited to; as a rectangle, cylinder, square, freeform or other entity such as a handgrip or stock.

Figure 19:
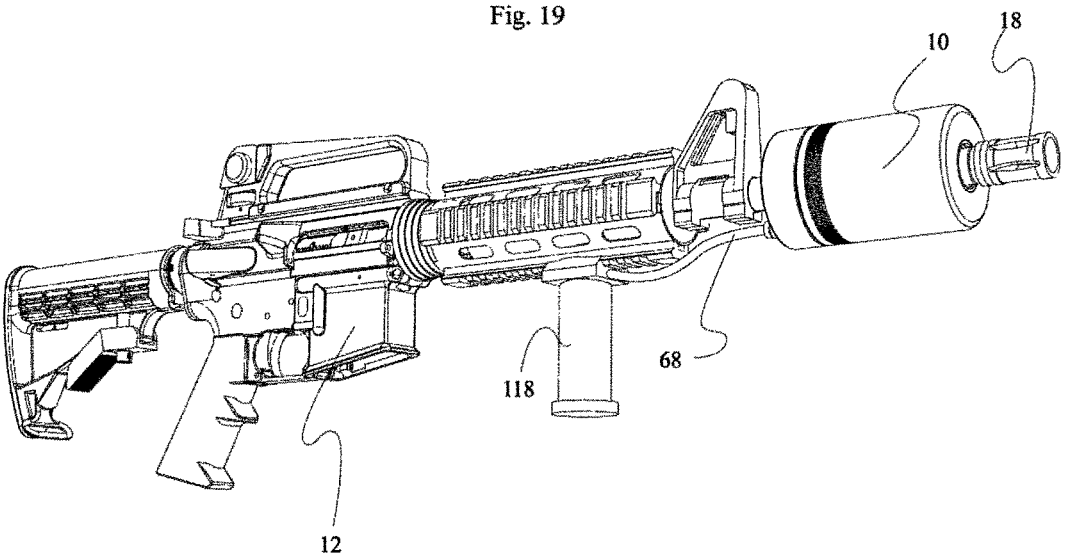
FIG. 19 illustrates another embodiment of the motorized weapon gyroscopic stabilizer as mounted by way of example to a rifle type weapon. In this embodiment, the battery case is incorporated into a hand grip attached to the rifle type weapon

FIG. 19 illustrates another embodiment of the motorized weapon gyroscopic stabilizer 10 as mounted by way of example to a rifle type weapon 12. In this illustration, the motorized weapon gyroscopic stabilizer 10 is positioned on the barrel 14 with the flash suppressor 18 located in front of it. In this embodiment, the battery case 66 is incorporated into a hand grip 118 attached to the rifle type weapon 12. The hand grip 118 can be made in several different ways and with different materials, and designed to hold the battery or batteries 82 in many different ways with different closure methods depending on the construction of the weapon 12. In this preferred embodiment, hand grip 118 is connected to the motorized weapon gyroscopic stabilizer 10 through a power cable 68, or may be connected directly to the motorized weapon gyroscopic stabilizer 10 providing the energy needed to power the motorized weapon gyroscopic stabilizer 10. The hand grip 118 may take many forms by way of example but not limited to; as a rectangle, cylinder, square, freeform or other entity.

Figure 20:
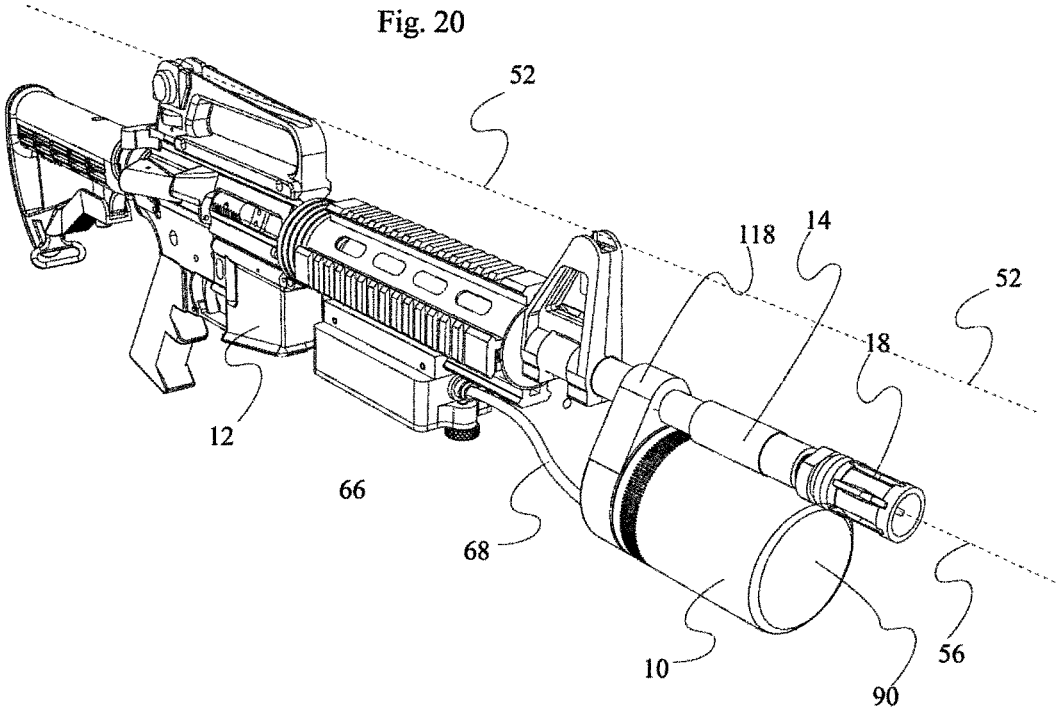
FIG. 20 illustrates another embodiment of the motorized weapon gyroscopic stabilizer by way of example mounted on the barrel but with the motorized weapon gyroscopic stabilizer having a closed end and not having the target alignment-line of sight or the projectile passing through the open core in the motorized weapon gyroscopic stabilizer.

FIG. 20 shows the barrel 14 of the rifle type weapon 12 still has a flash suppressor 18 located on the end of the barrel 14. In this illustration, the motorized weapon gyroscopic stabilizer 10 is attached to the barrel 14 by way of example but not limited to; as a mounting bracket 120 attachment method to the barrel 14. In this embodiment, the motorized weapon gyroscopic stabilizer 10 has a closed end of the gyroscopic weapon stabilizer 90 not having the target alignment-line of sight 52 nor the projectile passing through the open core in the motorized weapon gyroscopic stabilizer 56. The motorized weapon gyroscopic stabilizer 10 is attached to the battery case 66 mounted to the weapon housing-stock-hand grip 122 by the power cable 68, providing the motorized weapon gyroscopic stabilizer 10 the power to function. The battery case 66 may take many forms by way of example but not limited to; as a rectangle, cylinder, square, freeform or other entity such as a handgrip or stock.

Figure 21:
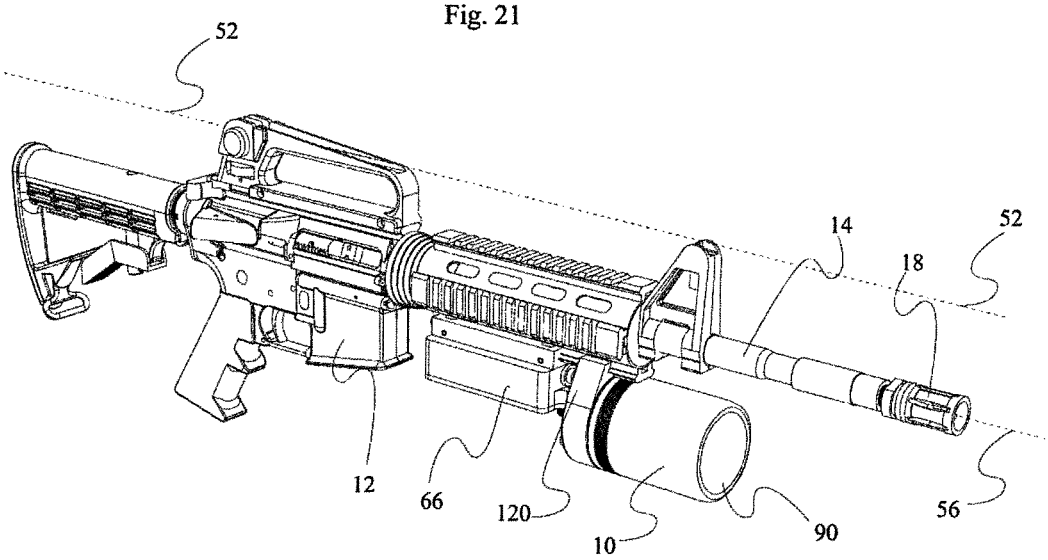
FIG. 21 illustrates another embodiment of the motorized weapon gyroscopic stabilizer by way of example mounted to the non-barrel part of the weapon with a closed end of the gyroscopic weapon stabilizer not having the target alignment-line of sight or the projectile passing through the open core in the motorized weapon gyroscopic stabilizer.

FIG. 21 illustrates another embodiment of the motorized weapon gyroscopic stabilizer 10 as mounted by way of example to a rifle type weapon 12. In this illustration, the motorized weapon gyroscopic stabilizer 10 is positioned below the barrel 14. The barrel 14 of the rifle type weapon 12 still has a flash suppressor 18 located on the end of the barrel 14. In this illustration, the motorized weapon gyroscopic stabilizer 10 is attached by way of example, to the non-barrel part of the weapon 12. In this embodiment, the motorized weapon gyroscopic stabilizer 10 has a closed end of the gyroscopic weapon stabilizer 90 not having the target alignment-line of sight 52 nor the projectile passing through the open core in the motorized weapon gyroscopic stabilizer 56. In this illustration, the motorized weapon gyroscopic stabilizer 10 is shown attaching by way of example by a mounting bracket 120 to the weapon 12. In this embodiment, the attachment system may take several forms, including but not limited to; a weaver type rail, a STANAG type rail, a picatinny type rail, a bolt-screw, a clip, a snap, a slide, a clasp, a handgrip, or any type of mounting bracket 120 designed to attach items to a rifle type weapon 12. The motorized weapon gyroscopic stabilizer 10 is attached to the battery case 66 mounted to the weapon housing-stock-handgrip 122 by the power cable 68, providing the motorized weapon gyroscopic stabilizer 10 the power to function. The battery case 66 may take many forms by way of example but not limited to; as a rectangle, cylinder, square, freeform or other entity such as a handgrip or stock.

Figure 22:
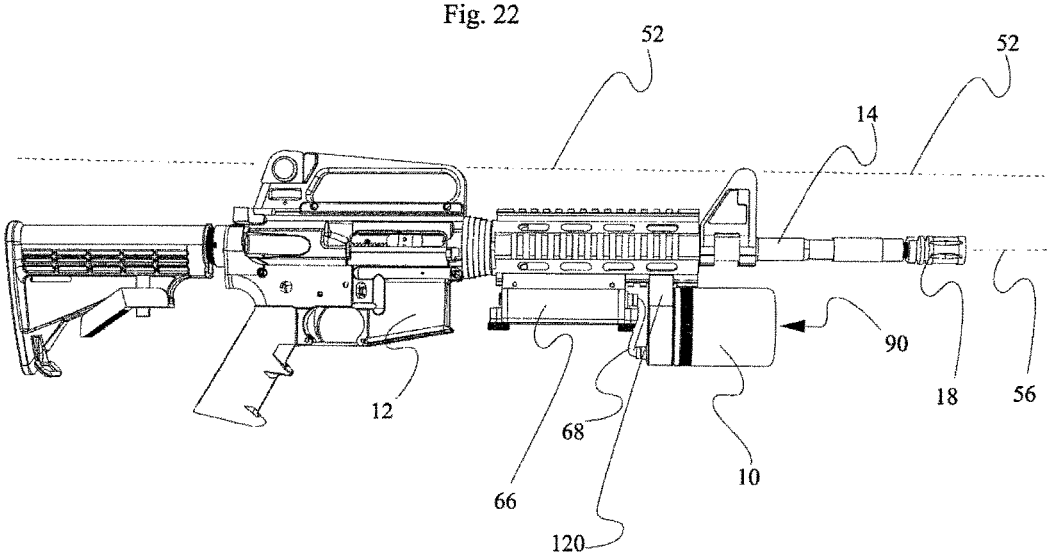
FIG. 22 shows a side view of the embodiment described in FIG. 21.

FIG. 22 shows a side view of the embodiment described in FIG. 21. The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Figure 23:
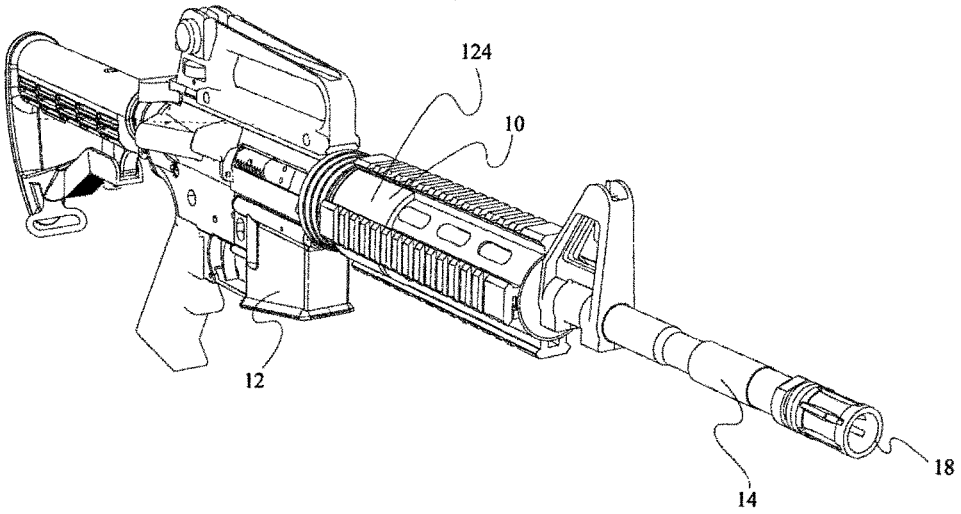
FIG. 23 illustrates another embodiment of the motorized weapon gyroscopic stabilizer by way of example incorporated into the rifle type weapon construction. In this drawing, the motorized weapon gyroscopic stabilizer is housed within the combination of a gyroscopic outer housing and the weapon housing-stock-handgrip, enclosing it within the natural form of the rifle type weapon.

FIG. 23 illustrates another embodiment of the motorized weapon gyroscopic stabilizer 10 as mounted by way of example to a rifle type weapon 12. In this illustration, the motorized weapon gyroscopic stabilizer 10 is incorporated into the combination of a gyroscopic outer housing and the weapon housing-stock-handgrip 124. The motorized weapon gyroscopic stabilizer 10 is relatively hidden from view and is not secured to the barrel 14 by the affixing of the flash suppressor 18, but is instead either directly or indirectly attached to the barrel 14, or attached to the rifle type weapon 12 via another attachment method. In this embodiment, the rile barrel 14 may by way of example form the center open core of the assembly onto which the bearings are attached. This positioning permits a less obtrusive incorporation of the invention onto or into the rifle type weapon 12, and a positioning which is more centralized in relationship to the rifle type weapon 12.

Figure 24:
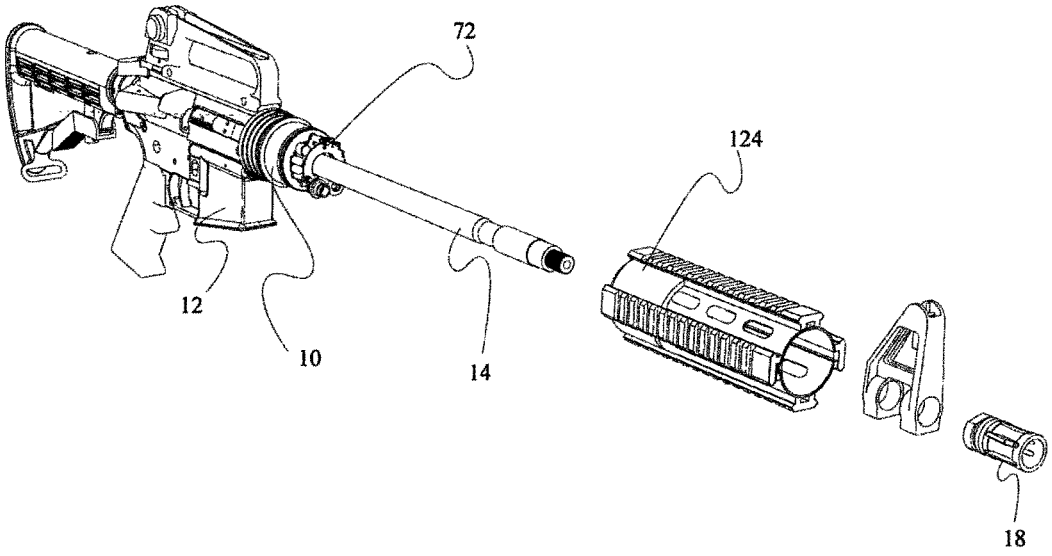
FIG. 24 is a partial exploded view of the embodiment illustrated in FIG. 23, showing the motorized weapon gyroscopic stabilizer by way of example functioning within the rifle type weapon structure.

FIG. 24 clarifies the embodiment illustrated in FIG. 23. In this view, the combination of a gyroscopic outer housing and the weapon housing-stock-handgrip 124 has been removed for clarity. The motorized weapon gyroscopic stabilizer 10 is shown attached to the rifle type weapon 12 and is by way of example either mounted directly or by another attachment method around the weapon barrel 14. By way of example, the flash suppressor 18 is not used to secure the motorized weapon gyroscopic stabilizer 10 to the rifle type weapon 12. The electronic power board 72 is shown by way of example mounted in front of the gyroscopic weapon stabilizer 10, although its position can be modified in its relationship to the rifle type weapon 12.

Figure 25:
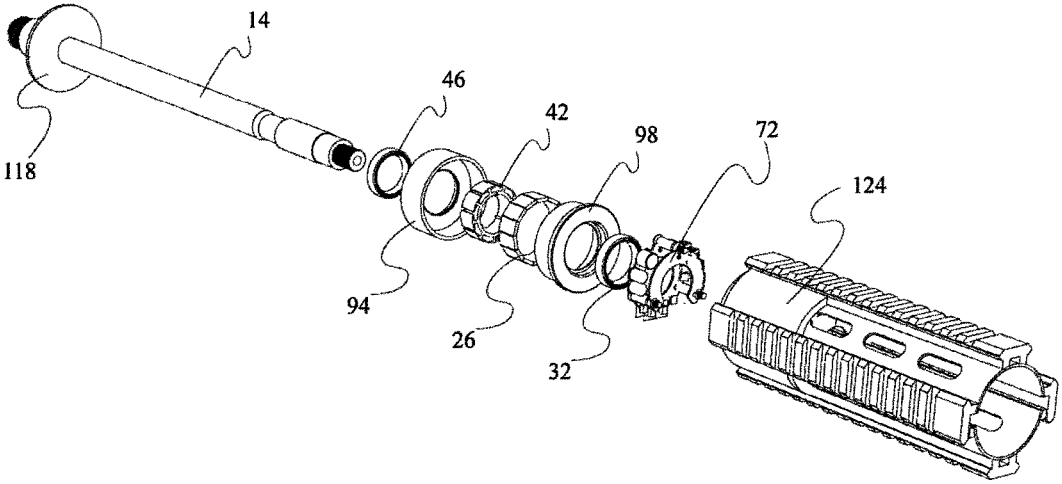
FIG. 25 shows the embodiment illustrated in FIG. 23 in an exploded view showing additional detail.

FIG. 25 is an exploded view of the motorized weapon gyroscopic stabilizer 10 contained within the combination of a gyroscopic outer housing and the weapon housing-stock-handgrip 124. This drawing further clarifies the embodiment illustrated in FIG. 23. In this embodiment, the rear portion of motorized weapon gyroscopic stabilizer housing 118 is either incorporated into, or attached to the weapon barrel 14. The rear bearing 46 is either attached directly to or attached via bracket to the weapon barrel 14. The rear bearing 46 is attached to the rear rotor half 94 which is attached to the front rotor half 98 and the front bearing 32. The front bearing 32 is either attached directly to or attached via bracket to the weapon barrel 14. Both the stator and windings 42 and the magnets 26 which are attached to the front rotor half 98 are held inside this assembly. The electronic power board 72 is shown by way of example in front of this assembly, but may be positioned in many different locations or attached remotely. The combination of a gyroscopic outer housing and the weapon housing-stock-handgrip 124 provides the front of this enclosure assembly. This embodiment of the motorized weapon gyroscopic stabilizer 10 further incorporates the invention into the construction of the rifle type weapon 12.

Figure 26:
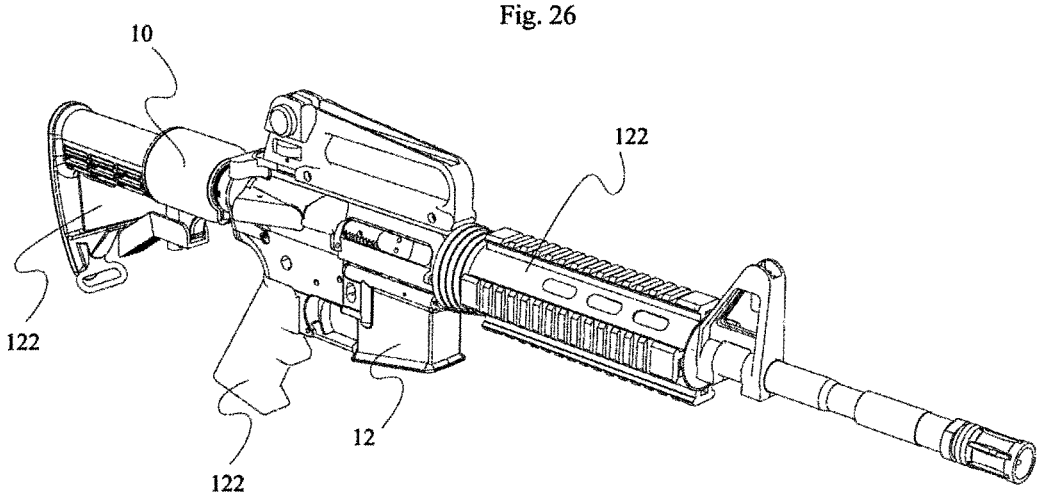
FIG. 26 illustrates the motorized weapon gyroscopic stabilizer by way of example incorporated into the rear weapon housing-stock of a rifle type weapon. This drawing illustrates how the gyroscopic weapon stabilizer can be incorporated into the natural form of a rifle type weapon, and be either partially or fully enclosed within the natural form of the rifle type weapon.

FIG. 26 illustrates by way of example another embodiment of the motorized weapon gyroscopic stabilizer 10 as mounted onto the rifle type weapon 12. Depending on the rifle type weapon 12 style, the weapon housing-stock 122 can take many forms. In some forms, the weapon housing-stock can be made in separate pieces as shown in this illustration, but in other configurations, this weapon housing-stock 122 can be made as one combined part. In this illustration, the motorized weapon gyroscopic stabilizer 10 is incorporated into the rear portion of the weapon housing-stock 122. This rear portion of the weapon housing-stock 122 can be constructed as a separate rear component of the rifle type weapon 12, or in combination with a stock which has many parts depending on the construction of the rifle type weapon 12. The placement of the motorized weapon gyroscopic stabilizer 10 in the rear portion of the weapon housing-stock 122 can be made either visible or hidden depending on the rifle type weapon 12 construction.

Figure 27:
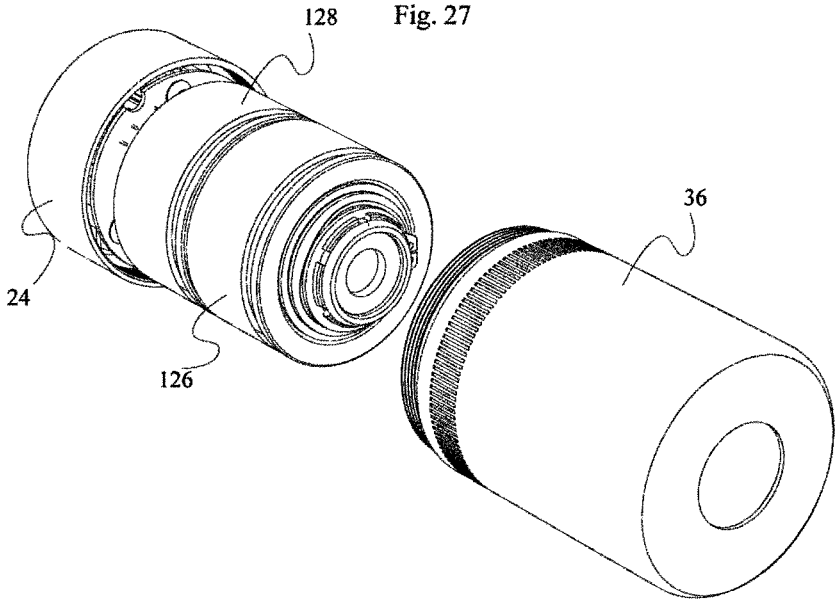
FIG. 27 illustrates another embodiment in a partially exploded view of the motorized weapon gyroscopic stabilizer where by way of example, two rotor assemblies can be incorporated into the housing with opposing directional rotation which counteracts gyroscopic precession.

FIG. 27 illustrates by way of example another embodiment of the motorized weapon gyroscopic stabilizer 10. In this drawing, the motorized weapon gyroscopic stabilizer 10 is shown to contain two separate gyroscopic rotor assemblies. This embodiment has a front rotor assembly 126 and a rear rotor assembly 128. By way of example, in this one possible assembly variation, the two rotor halves are contained within an inner housing 24 and an outer housing 36. These two rotors are designed to operate in opposing directions to eliminate the gyroscopic precession effect. This configuration of the internal rotors may be applied to any and all forms of the motorized weapon gyroscopic stabilizer 10.

Figure 28:
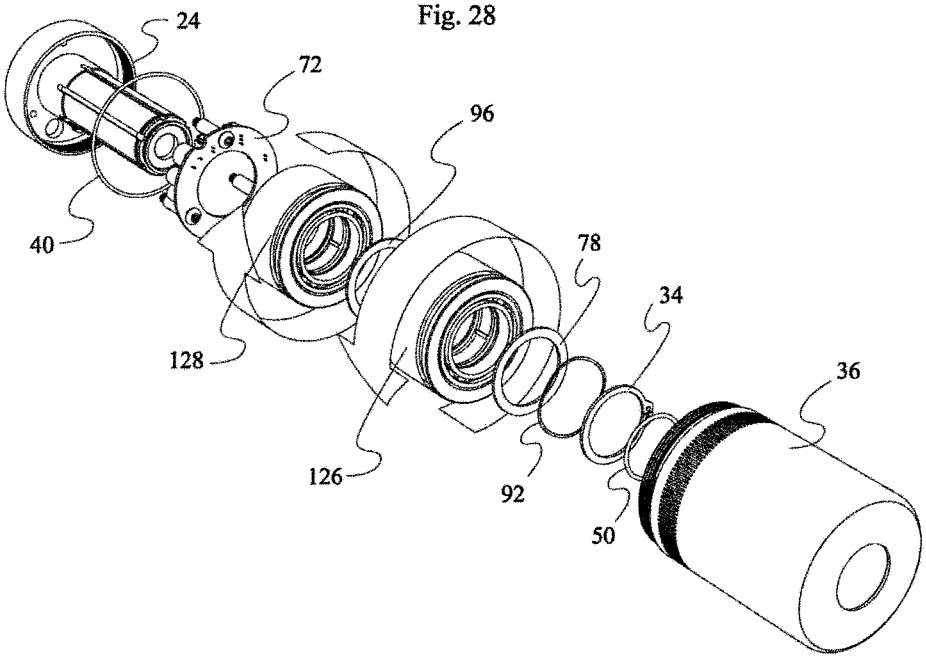
FIG. 28 is another partial exploded view of the embodiment shown in FIG. 27 showing by way of example the motorized weapon gyroscopic stabilizer with two rotor assemblies rotating in opposite directions.

FIG. 28 illustrates by way of example a clarification of the drawing in FIG. 27 as a partial exploded view of the assembly shown in FIG. 27. By way of example, the gyroscopic weapon stabilizer 10 is constructed using two gyroscopic rotors mounted onto the inner housing 24, a front rotor assembly 126, and a rear rotor assembly 128. The electronic power board is configured to power the two rotor assemblies in opposing rotational directions. By doing this, the gyroscopic weapon stabilizer 10 eliminates the gyroscopic precession effect. By way of example, he entire assembly is housed within the outer housing 36.

Figure 29:
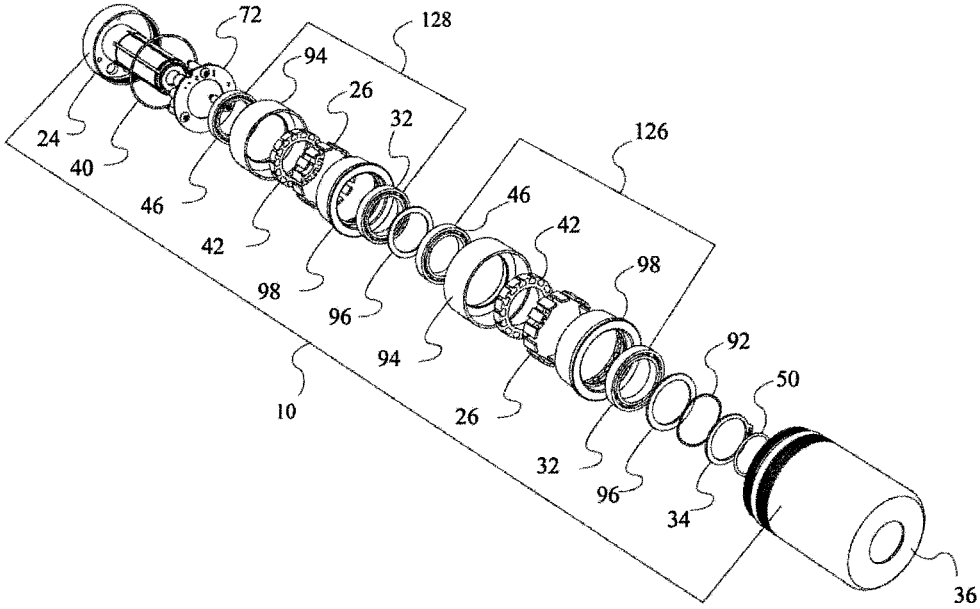
FIG. 29 shows a fully exploded view of the motorized gyroscopic stabilizer illustrated in FIG. 27.

FIG. 29 illustrates by way of example a fully exploded view of the drawing shown in FIG. 27. In this embodiment, the inner housing 24 forms the hollow core which all of the elements are attached. The electronic power board 72 may be mounted in a wide variety of places, however in this embodiment; it is attached to the inner housing 24, and powers the motorized weapon gyroscopic stabilizer 10. To form the rear rotor assembly 128, the rear bearing 46 is directly attached to the rear rotor half 94. The rear bearing 46 rotates on the inner housing 24 outer support surface. The magnets 26 are mounted within the front rotor assembly 98. The front bearing 32 is also mounted inside the front rotor half 98. The front bearing 32 rotates on the inner housing 24 outer support surface. The stator and windings 42 are securely mounted to the outer bearing surface of the inner housing 24, and is enclosed within the rear rotor half 94 and the front rotor half 98. The rear rotor half 94 and front rotor half 98 when attached together form a complete and independent rear rotor assembly 128. The rear rotor assembly 128 and front rotor assembly 126 are separated by spacer ring 96. To form the front rotor assembly 126, the rear bearing 46 is directly attached to the rear rotor half 94. The rear bearing 46 rotates on the inner housing 24 outer support surface. The magnets 26 are mounted within the front rotor assembly 98. The front bearing 32 is also mounted inside the front rotor half 98. The front bearing 32 rotates on the inner housing 24 outer support surface. The stator and windings 42 are securely mounted to the outer bearing surface of the inner housing 24, and is enclosed within the rear rotor half 94 and the front rotor half 98. The rear rotor half 94 and front rotor half 98 when attached together form a complete and independent front rotor assembly 126. Both front rotor assembly 126 and rear rotor assembly 128 and the electronic power board 72 are housed within the outer housing 36 which when attached to the inner housing 24 creates an enclosed structure. By constructing the motorized weapon gyroscopic stabilizer in this fashion, the front rotor assembly 126 and the rear rotor assembly 128 are allowed to rotate in opposite directions and eliminate gyroscopic precession.

Figure 30:
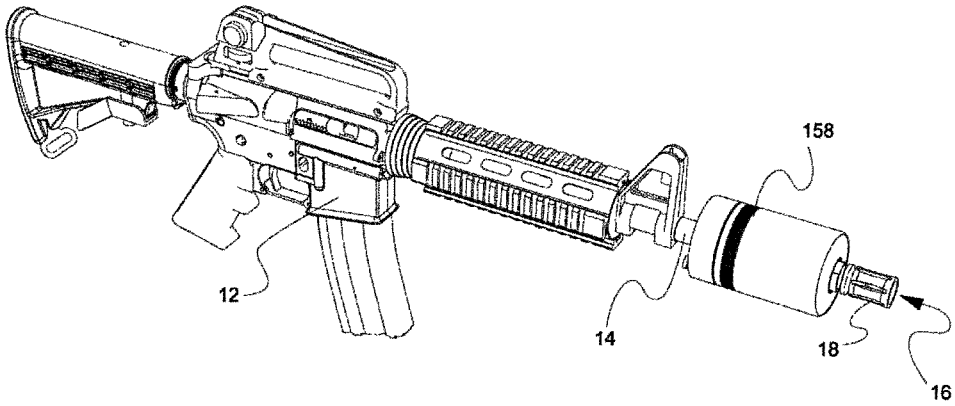
FIG. 30 shows another exemplary motorized weapon gyroscopic stabilizer in accordance with the present disclosure.

FIG. 30 shows another exemplary embodiment of the disclosure which is a motorized weapon gyroscopic stabilizer with pivoting rotor 158, with the ability to provide enhanced gyroscopic stability through the use of a non-fixed orientation 360 degree pivoting limited-rotation core with its rotating mass, as mounted by way of example to a weapon 12. In this drawing of the exemplary embodiment, the device 158 is mounted to the weapon barrel 14. The device is secured to the barrel 14 by the flash suppressor 18. The motorized weapon gyroscopic stabilizer with pivoting rotor 158 allows the projectile to pass through it, go through the barrel 14 to the projectile exit 16. The illustration shows that the motorized weapon gyroscopic stabilizer with pivoting rotor 158 may or not have the same outward appearance as the non-pivoting version of the device as shown in previous embodiments.

Figure 31:
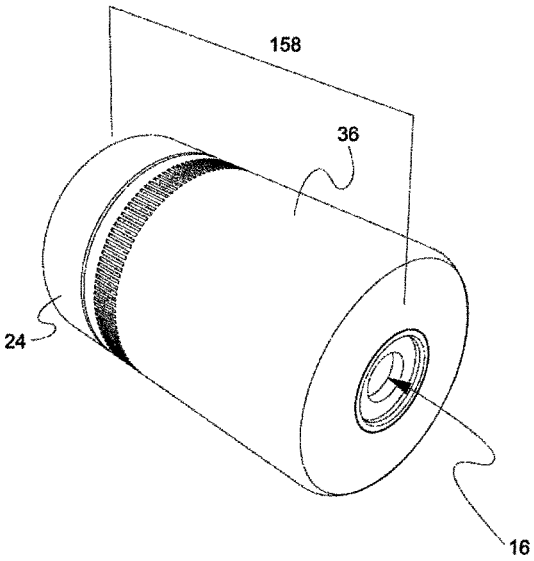
FIG. 31 shows the motorized weapon gyroscopic stabilizer of FIG. 30 separate from the weapon.

FIG. 31 illustrates the motorized weapon gyroscopic stabilizer with pivoting rotor 158 alone (e.g., not mounted on a weapon). The illustration shows that the motorized weapon gyroscopic stabilizer with pivoting rotor 158 may or not have the same outward appearance as the earlier exemplary embodiments. In this view, the motorized weapon gyroscopic stabilizer with pivoting rotor 158 is shown to have an outer housing 36, inner housing 24, and a projectile exit 16. In some of the applications of the motorized weapon gyroscopic stabilizer with pivoting rotor 158, the projectile exit 16 may or may not be incorporated into the device. In other embodiments, the rotor 158 can be solid core (e.g., without a central bore extending therethrough).

Figure 32:
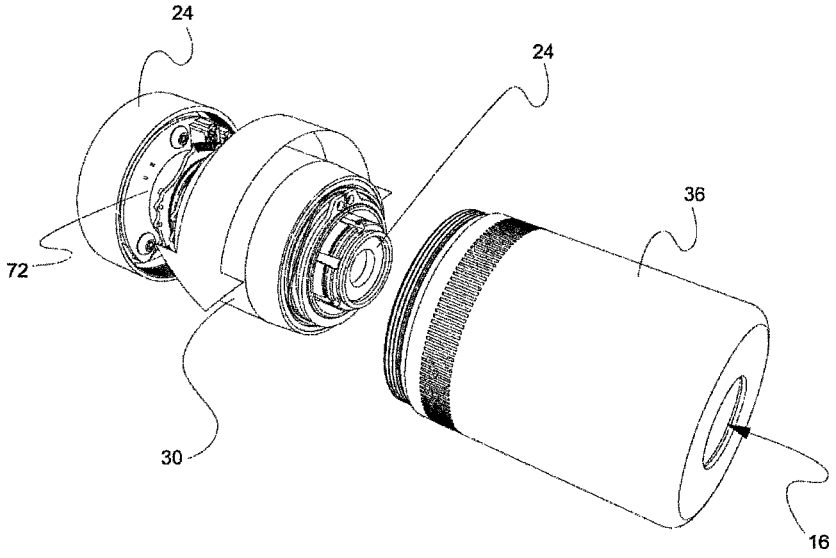
FIGS. 32 and 33 show a partially exploded view of the motorized weapon gyroscopic stabilizer of FIG. 31.

FIG. 32 illustrates the motorized weapon gyroscopic stabilizer with pivoting rotor 158 with its outer housing 36 removed from the inner housing 24 for clarity. In this view, the directional arrows illustrate the spinning rotor 30 which is controlled by the electronic power board 72. The spinning rotor 30 creates the gyroscopic stabilizing force of motorized weapon gyroscopic stabilizer with pivoting rotor 158. The direction of rotation of the rotor 30 is not limited. In some of the applications of the motorized weapon gyroscopic stabilizer with pivoting rotor 158, the projectile exit 16 may or may not be incorporated into the device.

Figure 33:
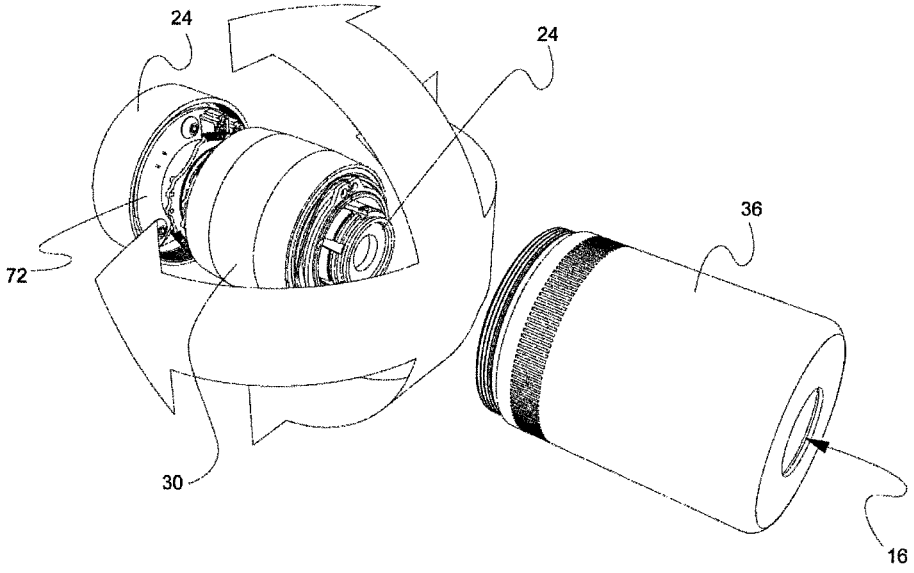

FIG. 33 illustrates the motorized weapon gyroscopic stabilizer with pivoting rotor 158 with its outer housing 36 removed from the inner housing 24 for clarity. In this partially exploded view of the non-fixed orientation 360 degree pivoting limited-rotation core with its non-fixed orientation spinning mass variation. In this view, the motorized weapon gyroscopic stabilizer with pivoting rotor 158 is shown with representative arrows showing the possible 360 degree pivoting in pitch and yaw directions of the spinning mass on the non-fixed orientation 360 degree pivoting limited-rotation core pivot sleeve 38. The rotor 30 is free to adapt to subtle changes in its directional orientation and help provide additional stability. The rotor 30 is driven by the electronic power board 72. In some of the applications of the motorized weapon gyroscopic stabilizer with pivoting rotor 158, the projectile exit 16 may or may not be incorporated into the device.

Figure 34:
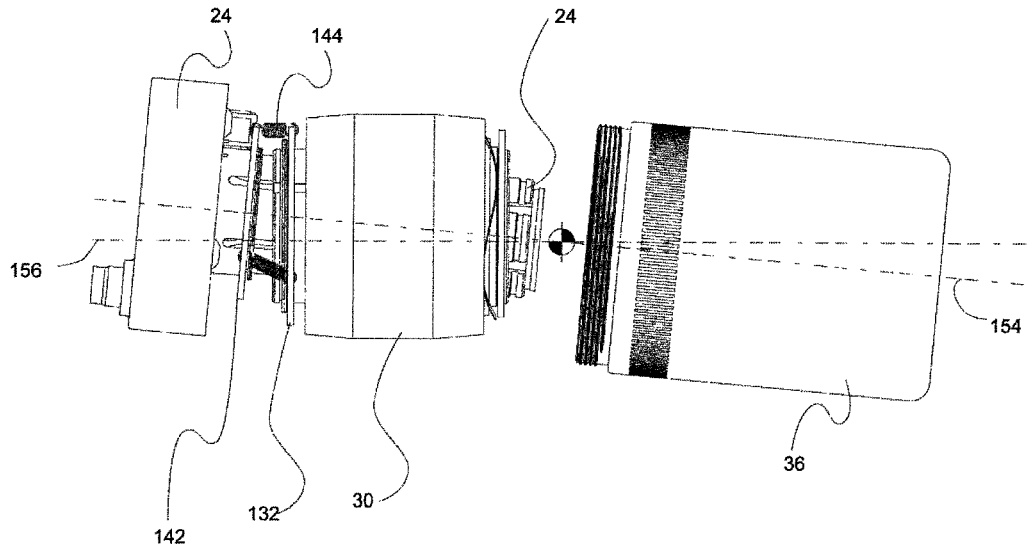
FIG. 34 shows a side view of the motorized weapon gyroscopic stabilizer responding to the application of an external force, such as deviations from the intended point of aim.

FIG. 34 illustrates the motorized weapon gyroscopic stabilizer with pivoting rotor 158 with its outer housing 36 removed from the inner housing 24 for clarity. In this view, the intended point of aim, dashed line 156, has been altered to a deviation from the intended point of aim, dashed line 154. For illustration purposes only, the view shows a deviation from the intended point of aim, dashed line 154 downward in its pitch (from dashed line 156). In response to this movement, the rotor 30 retains its original direction of rotation, and provides an upward force in its pitch in relationship to the changed pitch of the motorized weapon gyroscopic stabilizer with pivoting rotor 158. The motorized weapon gyroscopic stabilizer with pivoting rotor 158 adapts similarly to changes in yaw and all possible directional changes from the intended point of aim, dashed line 156. The rotor 30 rotates and creates the gyroscopic stability for the motorized weapon gyroscopic stabilizer with pivoting rotor 158, and at the same time is free to adapt to changes of pitch and yaw by pivoting on its non-fixed orientation 360 degree pivoting limited-rotation core pivot sleeve 38. The pivot sleeve spring plate 132 is attached to the non-fixed orientation 360 degree pivoting limited-rotation core pivot sleeve 38 and is also attached to the springs 144, which are attached to the inner housing spring plate 142, which is attached to the inner housing 24. The springs 144 held in position by fixed and indexed inner housing spring plate 144 and the fixed and indexed pivot sleeve spring plate 132, allow limited rotation of the non-fixed orientation 360 degree pivoting limited-rotation core pivot sleeve 38. The non-fixed orientation 360 degree pivoting limited-rotation core pivot sleeve 38 is however free to pivot in pitch and yaw on its domed ball pivot 130. The domed ball pivot 130 is not clearly seen in this view, but is shown in FIGS. 36. 37, 38, and 39.

Figure 35:
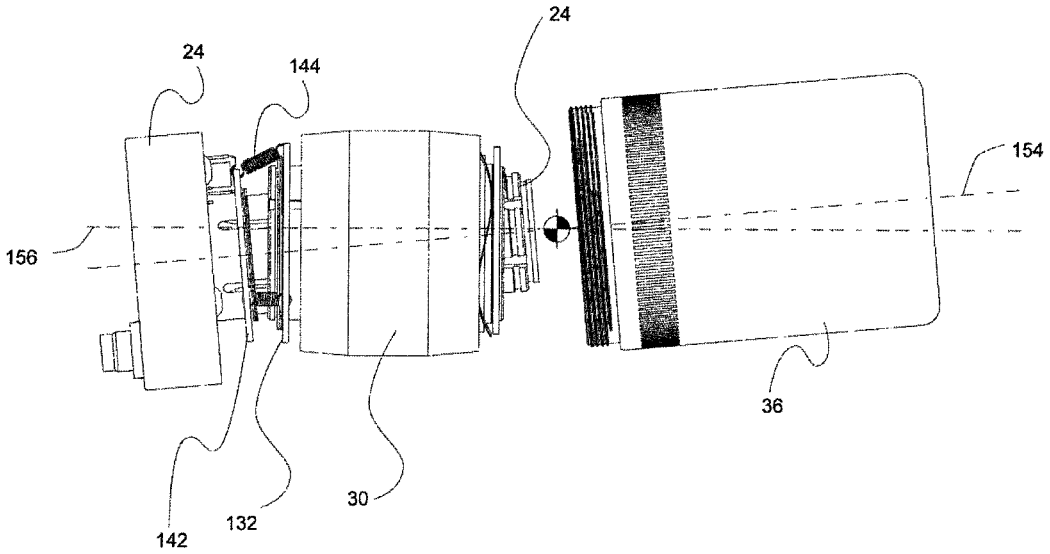
FIG. 35 a side view of the motorized weapon gyroscopic stabilizer responding to a upward angular change in the orientation of the device (for clarity, the outer housing has been removed)

FIG. 35 shows by way of example, a preferred embodiment of the motorized weapon gyroscopic stabilizer with pivoting rotor 158 with its outer housing 36 removed from the inner housing 24 for clarity. In this view, the intended point of aim, dashed line 156 has been altered to a deviation from the intended point of aim, dashed line 154. For illustration purposes only, the view shows a deviation from the intended point of aim, dashed line 154 upward in its pitch. In response to this movement, the rotor 30 retains its original direction of rotation, and provides a downward force in its pitch in relationship to the changed pitch of the motorized weapon gyroscopic stabilizer with pivoting rotor 158. The motorized weapon gyroscopic stabilizer with pivoting rotor 158 adapts similarly to changes in yaw and all possible directional changes from the intended point of aim, dashed line 156. The rotor 30 rotates and creates the gyroscopic stability for the motorized weapon gyroscopic stabilizer with pivoting rotor 158, and is free to adapt to changes of pitch and yaw by pivoting on its non-fixed orientation 360 degree pivoting limited-rotation core pivot sleeve 38. The pivot sleeve spring plate 132 is attached to the non-fixed orientation 360 degree pivoting limited-rotation core pivot sleeve 38 and is also attached to the springs 144, which are attached to the inner housing spring plate 142, which is attached to the inner housing 24. The springs 144 held in position by fixed and indexed inner housing spring plate 144 and the fixed and indexed pivot sleeve spring plate 132, allow limited rotation of the non-fixed orientation 360 degree pivoting limited-rotation core pivot sleeve 38. The non-fixed orientation 360 degree pivoting limited-rotation core pivot sleeve 38 is however free to pivot in pitch and yaw on its domed ball pivot 130. The domed ball pivot 130 is not clearly seen in this view, but is shown in FIGS. 36. 37, 38, and 39.

Figure 36:
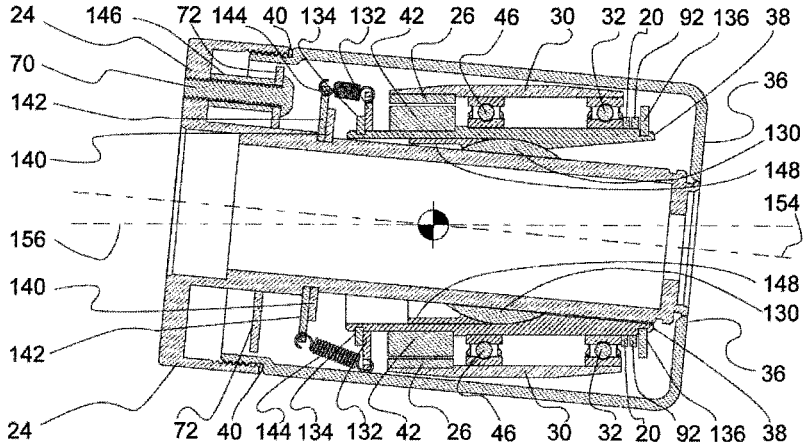
FIG. 36 shows a cutaway view of the device functioning when a downward force related to a deviation of the intended point of aim is applied.

FIG. 36 shows by way of example, the exemplary embodiment of the motorized weapon gyroscopic stabilizer with pivoting rotor 158 is shown in a cross sectional view demonstrating how the motorized weapon gyroscopic stabilizer with pivoting rotor 158 responds to changes to its intended point of aim, dashed line 156. In this view, the intended point of aim, dashed line 156 has been altered to a deviation from the intended point of aim, dashed line 154. For illustration purposes only, the view shows a deviation from the intended point of aim, dashed line 154 downward in its pitch. In response to this movement, the rotor 30 retains its original direction of rotation, and provides an upward force in its pitch in relationship to the changed pitch of the motorized weapon gyroscopic stabilizer with pivoting rotor 158. The motorized weapon gyroscopic stabilizer with pivoting rotor 158 adapts similarly to changes in yaw and all possible directional changes from the intended point of aim, dashed line 156.

Figure 39:
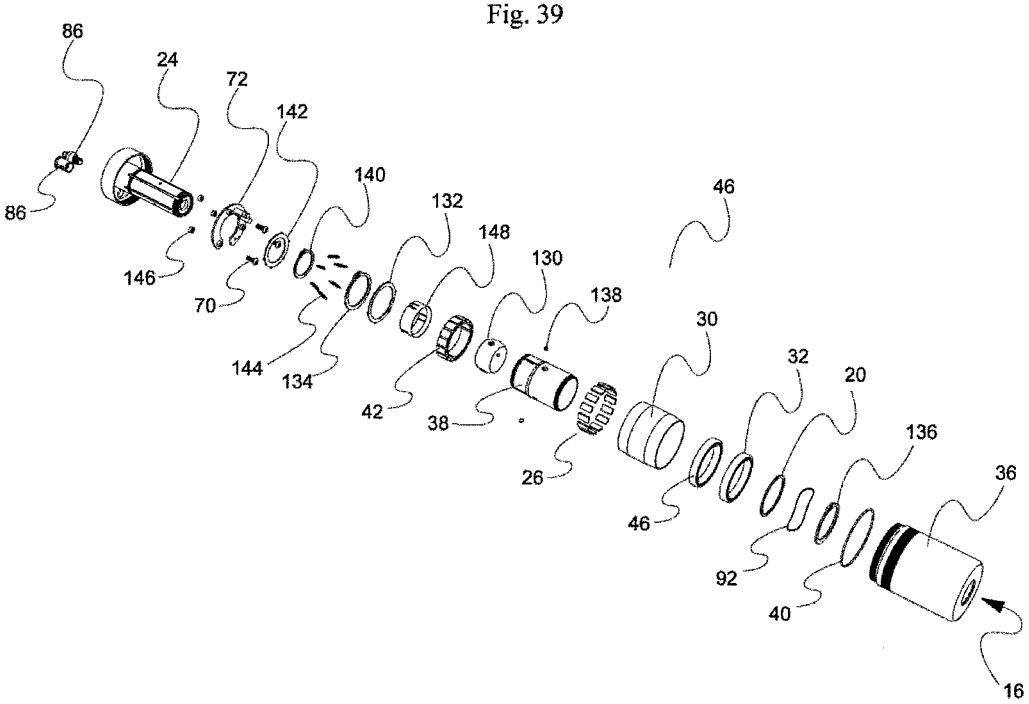
FIG. 39 shows an exploded view of an embodiment of the device.

In the exemplary embodiment of the device the inner housing 24, and the outer housing 36, along with the rear ring seal 40 encapsulate the device, keeping it free from exposure to outside elements. The retaining screws 70 hold the electronic power board 146 in place inside the inner housing 24, along with the spacers 146. The inner housing 24 has a grooved and indexed core to prevent the rotation of the inner housing spring plate 142, which is locked in place by the inner housing rear retainer 140. The springs 144 are attached to the inner housing spring plate 142 and the pivot sleeve spring plate 132 which is held in place by the grooves in the indexed and the non-fixed orientation 360 degree pivoting limited-rotation core pivot sleeve 38 and the pivots sleeve rear retainer 134. This connection allows the non-fixed orientation 360 degree pivoting limited-rotation core pivot sleeve 38 to freely pivot in the yaw and pitch directions and any angle between on the domed ball pivot 130, which is securely attached to the inner housing 24 with domed ball pivot pins 138. These pins are not shown in this view for clarity, but are shown in FIG. 39. The springs 132 limit the roll of the non-fixed orientation 360 degree pivoting limited-rotation core pivot sleeve 38 to a few degrees of rotation. The rear portion of the domed ball pivot 130 is held in position by the pivot lock 148 which is attached to the non-fixed orientation 360 degree pivoting limited-rotation core pivot sleeve 38. The non-fixed orientation 360 degree pivoting limited-rotation core pivot sleeve 38 and the pivot lock 148 form a concave surface to freely pivot on the convex shape of the domed ball pivot 130. The stator and windings 42 are indexed and locked into position in grooves in the non-fixed orientation 360 degree pivoting limited-rotation core pivot sleeve 38. The rotor 30 assembly is attached to the non-fixed orientation 360 degree pivoting limited-rotation core pivot sleeve 38 by a front bearing 32 and a rear bearing 46. This assembly is secured to the non-fixed orientation 360 degree pivoting limited-rotation core pivot sleeve 38 by a ring 20 a front wavy washer 92 and a pivot sleeve front retainer 136. The rotor 30 has magnets 26 bonded inside it to interact electronically with the stator and windings 42 causing the rotor 30 to spin as controlled by the electronic power board 72.

Figure 37:
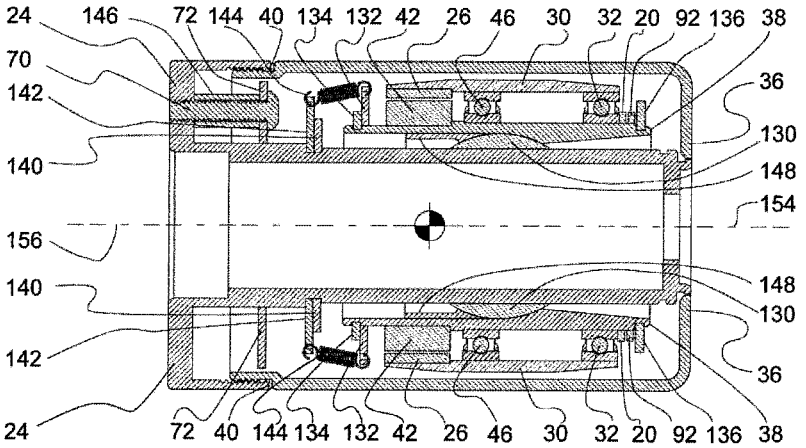
FIG. 37 shows a cutaway view of the device functioning when no deviation from the intended point of aim.

FIG. 37 shows the exemplary embodiment of the motorized weapon gyroscopic stabilizer with pivoting rotor 158 in a cross sectional view demonstrating how the motorized weapon gyroscopic stabilizer with pivoting rotor 158 responds to no changes to its intended point of aim, dashed line 156. In this view, the intended point of aim, dashed line 156 shows no deviation from the intended point of aim, dashed line 154. For illustration purposes only, the view shows the deviation from the intended point of aim, dashed line 154 as being non-existent. In response to this lack of movement, the rotor 30 retains its original direction of rotation, and provides no upward or downward force in its pitch in relationship to the motorized weapon gyroscopic stabilizer with pivoting rotor 158. The motorized weapon gyroscopic stabilizer with pivoting rotor 158 adapts similarly to changes in yaw and all possible directional changes from the intended point of aim, dashed line 156.

In this exemplary embodiment of the device, by way of example, the inner housing 24, and the outer housing 36, along with the rear ring seal 40 encapsulate the device, keeping it free from exposure to outside elements. The retaining screws 70 hold the electronic power board 146 in place inside the inner housing 24, along with the spacers 146. The inner housing 24 has a grooved and indexed core to prevent the rotation of the inner housing spring plate 142, which is locked in place by the inner housing rear retainer 140. The springs 144 are attached to the inner housing spring plate 142 and the pivot sleeve spring plate 132 which is held in place by the grooves in the indexed and the non-fixed orientation 360 degree pivoting limited-rotation core pivot sleeve 38 and the pivots sleeve rear retainer 134. This connection allows the non-fixed orientation 360 degree pivoting limited-rotation core pivot sleeve 38 to freely pivot in the yaw and pitch directions and any angle between on the domed ball pivot 130, which is securely attached to the inner housing 24 with domed ball pivot pins 138. These pins are not shown in this view for clarity, but are shown in FIG. 39. The springs 132 limit the roll of the non-fixed orientation 360 degree pivoting limited-rotation core pivot sleeve 38 to a few degrees of rotation. The rear portion of the domed ball pivot 130 is held in position by the pivot lock 148 which is attached to the non-fixed orientation 360 degree pivoting limited-rotation core pivot sleeve 38. The non-fixed orientation 360 degree pivoting limited-rotation core pivot sleeve 38 and the pivot lock 148 form a concave surface to freely pivot on the convex shape of the domed ball pivot 130. The stator and windings 42 are indexed and locked into position in grooves in the non-fixed orientation 360 degree pivoting limited-rotation core pivot sleeve 38. The rotor 30 assembly is attached to the non-fixed orientation 360 degree pivoting limited-rotation core pivot sleeve 38 by a front bearing 32 and a rear bearing 46. This assembly is secured to the non-fixed orientation 360 degree pivoting limited-rotation core pivot sleeve 38 by a ring 20 a front wavy washer 92 and a pivot sleeve front retainer 136. The rotor 30 has magnets 26 bonded inside it to interact electronically with the stator and windings 42 causing the rotor 30 to spin as controlled by the electronic power board 72.

Figure 38:
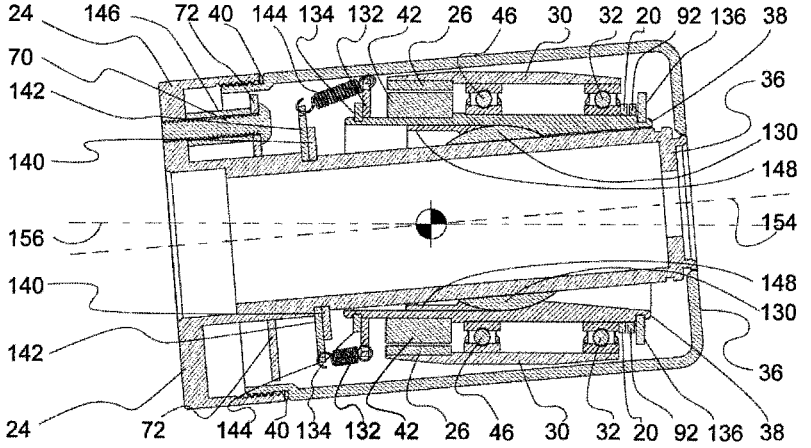
FIG. 38 shows a cutaway view of the device functioning when an upward force related to a deviation of the intended point of aim is applied.

FIG. 38 shows the exemplary embodiment of the motorized weapon gyroscopic stabilizer with pivoting rotor 158 in a cross sectional view demonstrating how the motorized weapon gyroscopic stabilizer with pivoting rotor 158 responds to changes to its intended point of aim, dashed line 156. In this view, the intended point of aim, dashed line 156 has been altered to a deviation from the intended point of aim, dashed line 154. For illustration purposes only, the view shows a deviation from the intended point of aim, dashed line 154 upward in its pitch. In response to this movement, the rotor 30 retains its original direction of rotation, and provides a downward force in its pitch in relationship to the changed pitch of the motorized weapon gyroscopic stabilizer with pivoting rotor 158. The motorized weapon gyroscopic stabilizer with pivoting rotor 158 adapts similarly to changes in yaw and all possible directional changes from the intended point of aim, dashed line 156.

In this exemplary embodiment of the device, by way of example, the inner housing 24, and the outer housing 36, along with the rear ring seal 40 encapsulate the device, keeping it free from exposure to outside elements. The retaining screws 70 hold the electronic power board 146 in place inside the inner housing 24, along with the spacers 146. The inner housing 24 has a grooved and indexed core to prevent the rotation of the inner housing spring plate 142, which is locked in place by the inner housing rear retainer 140. The springs 144 are attached to the inner housing spring plate 142 and the pivot sleeve spring plate 132 which is held in place by the grooves in the indexed and the non-fixed orientation 360 degree pivoting limited-rotation core pivot sleeve 38 and the pivots sleeve rear retainer 134. This connection allows the non-fixed orientation 360 degree pivoting limited-rotation core pivot sleeve 38 to freely pivot in the yaw and pitch directions and any angle between on the domed ball pivot 130, which is securely attached to the inner housing 24 with domed ball pivot pins 138. These pins are not shown in this view for clarity, but are shown in FIG. 39. The springs 132 limit the roll of the non-fixed orientation 360 degree pivoting limited-rotation core pivot sleeve 38 to a few degrees of rotation. The rear portion of the domed ball pivot 130 is held in position by the pivot lock 148 which is attached to the non-fixed orientation 360 degree pivoting limited-rotation core pivot sleeve 38. The non-fixed orientation 360 degree pivoting limited-rotation core pivot sleeve 38 and the pivot lock 148 form a concave surface to freely pivot on the convex shape of the domed ball pivot 130. The stator and windings 42 are indexed and locked into position in grooves in the non-fixed orientation 360 degree pivoting limited-rotation core pivot sleeve 38. The rotor 30 assembly is attached to the non-fixed orientation 360 degree pivoting limited-rotation core pivot sleeve 38 by a front bearing 32 and a rear bearing 46. This assembly is secured to the non-fixed orientation 360 degree pivoting limited-rotation core pivot sleeve 38 by a ring 20 a front wavy washer 92 and a pivot sleeve front retainer 136. The rotor 30 has magnets 26 bonded inside it to interact electronically with the stator and windings 42 causing the rotor 30 to spin as controlled by the electronic power board 72.

FIG. 39 provides by way of example an exploded view of the exemplary embodiment of the motorized weapon gyroscopic stabilizer with pivoting rotor 158. In this view all of the parts discussed in FIGS. 36, 37, and 38 are shown in a perspective view with the addition of further details showing the electrical terminals 86 attached to the inner housing 24, and the domed ball pivot pins 138 used to securely fasten the domed ball pivot 130 to the inner housing 24.

Figure 40:
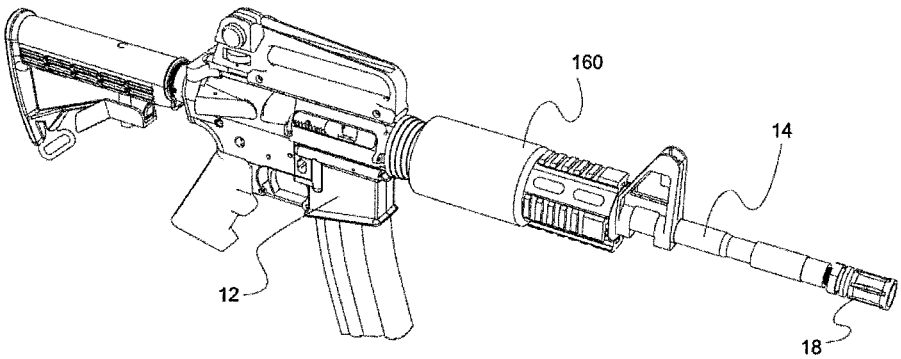
FIG. 40 shows an exemplary embodiment of the device used on the barrel of the weapon.

FIG. 40 shows an exemplary embodiment of the device used on of barrel 14 of the weapon 12, as by way of example incorporated into the firearm weapon housing-stock-handgrip 122. In this view, the motorized weapon gyroscopic stabilizer with pivoting rotor 158 takes on a different construction and shares existing elements of the weapon 12. The device is shown as a combination of outer housing and stock-handgrip and the motorized weapon gyroscopic stabilizer with pivoting rotor 160. In this view, the construction of the device may be either fully enclosed within the construction of the weapon housing-stock-handgrip 122, or partially enclosed or fully exposed. The motorized weapon gyroscopic stabilizer with pivoting rotor 158 is shown to allow the barrel 14 to pass through it.

Figure 41:
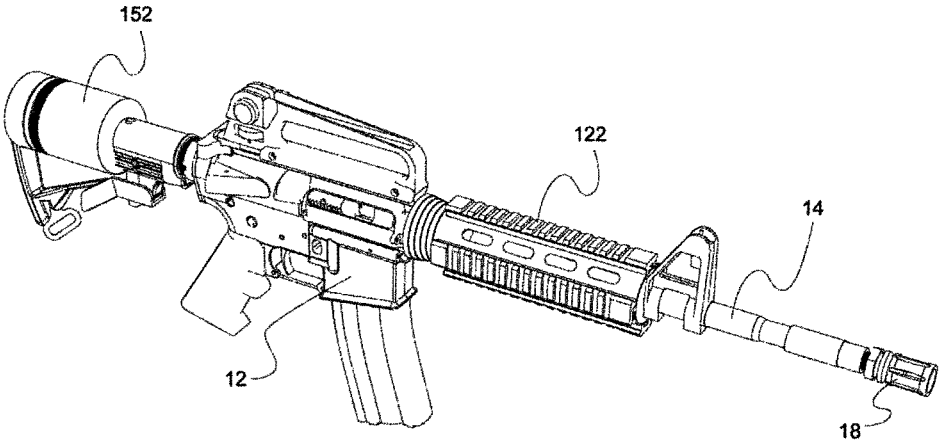
FIG. 41 shows by way of example, an embodiment of the device as used on the rear portion of the firearm, as by way of example incorporated into the firearm butt stock.

FIG. 41 shows an exemplary embodiment of the disclosure wherein a motorized weapon gyroscopic stabilizer with pivoting rotor 152 is by way of example incorporated into the weapon structure, in what is commonly called the butt stock. In this view, the motorized weapon gyroscopic stabilizer with pivoting rotor 158 takes on a different construction and shares existing elements of the weapon 12. The weapon stock with a motorized weapon gyroscopic stabilizer with pivoting rotor 152 does not attach to the barrel 14 of the weapon 12, and is not held in place by the flash suppressor 18. In this view, the construction of the device may be either fully enclosed within the construction of the weapon housing-stock-handgrip 122, or partially enclosed, or fully exposed.

Figure 42:
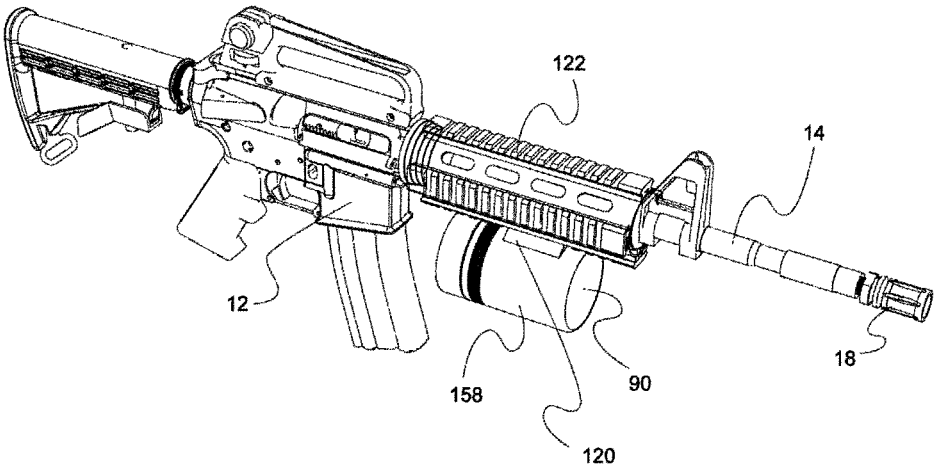
FIG. 42 shows by way of example an embodiment of the device as freely attached either permanently or temporarily to another part of the firearm.

FIG. 42 yet another exemplary embodiment of the disclosure wherein the motorized weapon gyroscopic stabilizer with pivoting rotor 152 as freely attached either permanently or temporarily to another part of the firearm 12. In this illustration, by way of example, the motorized weapon gyroscopic stabilizer with pivoting rotor 158 is attached to the firearms weapon housing-stock-handgrip 122 as either a permanent or detachable accessory, independent of mounting it onto the barrel 14 or the flash suppressor 18 of the weapon 12. In this embodiment the device may or not be attached to the weapon housing-stock-handgrip 122 with a mounting bracket 120. In this example, the motorized weapon gyroscopic stabilizer with pivoting rotor 158 does not need to have a hollow core, and could be used as a solid core device with the same pivoting and rotating of the spinning gyroscopic rotor needed to provide gyroscopic stability to the device and the item it is attached to. By not having the barrel 14 pass through the device, it can have a closed end 90 on the motorized weapon gyroscopic stabilizer with pivoting rotor 158.

It should be appreciated that both solid core and hollow core rotational masses are contemplated depending on a particular application. In some applications, a solid core mass may be preferred over a hollow core mass and vice versa.

Having thus described the preferred embodiments, the invention is now claimed to be:

1. A gyroscopic stabilizer system for weaponry, the system comprising:

a mass element mounted for rotation about an axis extending through the mass element; and a mounting structure configured to mount the mass element to an associated weapon, the mounting structure supporting the mass element such that it is pivotable relative to the mounting structure about at least two axes orthogonal to the axis of rotation and each other; and wherein the mounting structure supports the mass element for pivoting movement about at least two axes orthogonal to the axis of rotation and each other at a common position between opposite ends of the mass element with a ball and socket.

2. A system as set forth in claim 1, wherein the mass element is a hollow core mass element having a bore extending therethrough, with the axis of rotation extending through the bore, or a solid core mass element.

3. A gyroscopic stabilizer system for weaponry, the system comprising:

a mass element mounted for rotation about an axis extending through the mass element; and a mounting structure configured to mount the mass element to an associated weapon, the mounting structure supporting the mass element such that it is pivotable relative to the mounting structure about at least two axes orthogonal to the axis of rotation and each other;

wherein the mass element is a hollow core mass element having a bore extending therethrough, with the axis of rotation extending through the bore; and wherein the mounting structure includes a tubular inner housing and an outer housing defining a chamber in which the hollow core mass element is supported by at least one bearing, the tubular inner housing member extending at least partially into the bore of the hollow core mass element.

4. The system according to claim 3, further comprising a pivot member supported on a radially outer surface of the inner housing member, and a pivot sleeve pivotally engaged with said pivot member for pivoting movement relative to the inner housing member, wherein the at least one bearing is supported by the pivot sleeve.

5. The system according to claim 4, further comprising at least one limiter element extending between the pivot sleeve and the inner housing for restricting movement between the pivot sleeve and the inner housing.

6. The system according to claim 5, wherein the at least one limiter element includes a spring.

7. The system according to claim 6, further comprising a plurality of limiter elements extending between the pivot sleeve and the inner housing for restricting movement between the pivot sleeve and the inner housing, said limiter elements spaced radially about the inner housing.

8. The system according to claim 2, wherein the hollow core mass element is cylindrical and the mounting structure is configured to mount the hollow core mass element for rotation around the trajectory of a fired projectile and/or a line of sight.

9. The system according to claim 2, wherein the hollow core mass element is cylindrical to define an interior bore and wherein the mounting structure mounts the hollow core mass element such that either a projectile passes through the bore of the mass element or a sighting mechanism sights through the bore of the mass element.

10. The system according to claim 1, wherein the mass element comprises a rotor portion of an electric motor.

11. The system according to claim 2, wherein the hollow core mass element is mounted in at least one of a position spaced longitudinally from a barrel of the associated weapon, coextensive with a barrel of the associated weapon, or surrounding a barrel of the associated weapon with at least a portion of the barrel within the bore of the hollow core mass element.

12. A gyroscopic stabilizer system for weaponry, the system comprising:

a mass element mounted for rotation about an axis extending through the mass element; and a mounting structure configured to mount the mass element to an associated weapon, the mounting structure supporting the mass element such that it is pivotable relative to the mounting structure about at least two axes orthogonal to the axis of rotation and each other wherein the mounting structure is configured to mount the mass element to an accessory which is either permanently affixed or temporarily affixed to the weapon, the accessory including at least one of a flash suppressor, a sighting mechanism, a laser, a muzzle brake, a sound suppressor, a gas tube, or a compensator.

13. The system according to claim 1, further including an electric motor which rotates the mass element around the axis of rotation.

14. The system according to claim 1, further comprising an outer housing, the outer housing and inner housing being secured together, wherein the mass element is enclosed within the inner housing and the outer housing.

15. A weapon including the system of claim 1.

16. A method for stabilizing a weapon, the method comprising:

mounting a mass element for rotation about an axis extending through the mass element with a mounting structure configured to mount the mass element to the weapon, the mounting structure supporting the mass element such that it is pivotable relative to the mounting structure about at least two axes orthogonal to the axis of rotation and each other; and rotating the mass element around the axis of rotation;

wherein the mass element is a hollow core mass element having a bore extending therethrough, with the axis of rotation extending through the bore; and wherein the hollow core mass element is mounted in at least one of a position spaced longitudinally from a barrel of the associated weapon, coextensive with a barrel of the associated weapon, or surrounding a barrel of the associated weapon with at least a portion of the barrel within the bore of the hollow core mass element.

17. The method of claim 16, wherein the mass element includes a bore extending therethrough with the axis of rotation extending through the bore.

18. The method according to claim 17, wherein the mass element is cylindrical and the mounting of the mass element and at least one bearing for rotation is around the trajectory of the fired projectile and/or a line of sight.

19. The method according to claim 18, wherein the mounting of the mass element and at least one bearing is to an accessory which is either permanently affixed or temporarily affixed to the weapon, the accessory including at least one of a flash suppressor, a sighting mechanism, a laser, a muzzle brake, a sound suppressor, a gas tube, or a compensator.

20. A mounting structure configured to mount an associated mass element to an associated weapon, the mounting structure comprising:

a tubular housing having a bore extending therethrough and having a radially inner wall and a radially outer wall, and a chamber between the inner wall and the outer wall for containing the associated mass element;

a pivoting member secured to the inner wall within the chamber; and a pivot sleeve coupled to the pivoting member;

wherein the pivot sleeve is adapted to support the associated mass for rotation about an axis extending through the bore, the pivot sleeve pivotable relative to the inner wall of the tubular housing about at least two axes orthogonal to the axis extending through the bore and each other.

21. A weapon including the system of claim 1 mounted thereto.

* * * * *